US012186635B2

(12) United States Patent
Woodward et al.

(10) Patent No.: US 12,186,635 B2
(45) Date of Patent: Jan. 7, 2025

(54) IRON WITH MASS PAD

(71) Applicant: KARSTEN MANUFACTURING CORPORATION, Phoenix, AZ (US)

(72) Inventors: Alex G. Woodward, San Francisco, CA (US); Thomas M. Malota, Gilbert, AZ (US); Cole D. Brubaker, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 22 days.

(21) Appl. No.: 18/330,328

(22) Filed: Jun. 6, 2023

(65) Prior Publication Data

US 2023/0390617 A1 Dec. 7, 2023

Related U.S. Application Data

(60) Provisional application No. 63/365,942, filed on Jun. 6, 2022.

(51) Int. Cl.
*A63B 53/04* (2015.01)

(52) U.S. Cl.
CPC ..... *A63B 53/0475* (2013.01); *A63B 53/0408* (2020.08); *A63B 53/0433* (2020.08); *A63B 2053/0491* (2013.01)

(58) Field of Classification Search
CPC ..... A63B 53/0475; A63B 2053/0491
See application file for complete search history.

(56) References Cited

U.S. PATENT DOCUMENTS

| | | | | |
|---|---|---|---|---|
| 5,913,735 | A * | 6/1999 | Kenmi | A63B 60/00 29/447 |
| 6,045,456 | A | 4/2000 | Best | |
| 6,533,679 | B1 * | 3/2003 | McCabe | A63B 60/02 473/335 |
| 6,638,183 | B2 | 10/2003 | Takeda | |
| 6,921,344 | B2 | 7/2005 | Gilbert | |
| 8,202,174 | B2 | 6/2012 | Breier | |
| 8,337,325 | B2 | 12/2012 | Boyd | |
| 8,858,364 | B2 | 10/2014 | Deng | |
| 9,138,621 | B2 | 9/2015 | Roach | |
| 9,895,584 | B1 | 2/2018 | Su | |
| 10,625,126 | B2 | 4/2020 | Demkowski | |
| 10,765,920 | B2 | 9/2020 | Sander | |

(Continued)

FOREIGN PATENT DOCUMENTS

| | | |
|---|---|---|
| JP | 4326065 | 9/2009 |
| TW | 200909025 | 3/2009 |

OTHER PUBLICATIONS

"Cobra Golf introduces All New Aerojet Irons," <https://drivingrangeheroes.com/cobra-golf-introduces-all-new-aerojet-irons/>, Date accessed: Feb. 1, 2023.

(Continued)

*Primary Examiner* — Raeann Gorden

(57) ABSTRACT

Described herein are embodiments of an iron-type golf club head comprising a suspended weight bar within the interior cavity. The weight bar can be attached to and suspended in front of an internal mass pad. The weight bar overhangs at least a portion of the sole and is spaced away from the strike face. The weight bar thereby provides a low and forward center of gravity (CG) position without hindering the flexure of the strike face or the sole.

20 Claims, 20 Drawing Sheets

(56) References Cited

U.S. PATENT DOCUMENTS

| | | | | |
|---|---|---|---|---|
| 10,881,925 | B2 | 1/2021 | Demkowski | |
| 10,912,969 | B2 | 2/2021 | Matsunaga | |
| 10,960,280 | B2 | 3/2021 | Morales | |
| 10,967,233 | B2 | 4/2021 | Stokke | |
| 11,253,756 | B2 | 2/2022 | Hoffman | |
| 11,253,758 | B2 | 2/2022 | Huang | |
| 11,318,357 | B2 | 5/2022 | Bacon | |
| 11,980,796 | B1 * | 5/2024 | Hobbs | A63B 53/0433 |
| 2007/0155534 | A1 | 7/2007 | Tsai | |
| 2013/0344988 | A1 | 12/2013 | Hettinger | |
| 2014/0302944 | A1 | 10/2014 | Roach | |
| 2021/0162275 | A1 | 6/2021 | Demkowski | |

OTHER PUBLICATIONS

"Darkspeed irons," <https://www.cobragolf.com/collections/darkspeed-irons/products/darkspeed-irons>, Date accessed: Jan. 26, 2024.

* cited by examiner

IRON WITH MASS PAD

CROSS REFERENCE PRIORITIES

This claims the benefit of U.S. Provisional Application No. 63/365,942, filed Jun. 6, 2022, the contents of which are fully incorporated herein by reference.

TECHNICAL FIELD

This disclosure relates generally to golf club heads and, more particularly, relates to iron-type golf club heads that comprise an internal weight bar.

BACKGROUND

Center of gravity (CG) location is critical for providing a golf club head with optimal spin and launch characteristics. A low and forward CG is often desirable for an iron-type club head because such a CG position is known to improve ball speed and spin characteristics. Center of gravity location may be optimized by placing discretionary mass near the sole and close to the strike face. However, discretionary mass placement near the sole and close to the strike face is difficult in view of manufacturing constraints and can inhibit the flexibility of the sole and/or face, thereby reducing ball speed.

Many prior art iron-type club heads utilize various forms of discretionary mass to achieve a low and forward CG position. Some prior art iron-type club heads use removable or detachable internal and/or external weight members formed from a high-density material. Other prior art club heads cast complex mass pad geometries as an integral part of the club head body. However, such methods can be expensive and/or difficult to manufacture.

Providing a desirable (low and forward) CG position must be achieved in a way that preserves the flexibility of the club head. In an iron-type club head, it is desirable to provide a thin strike face and a thin sole proximate the strike face. Doing so promotes energy transfer between the club head and the golf ball at impact, thereby increasing ball speed. Club heads that place large mass pads on the sole and/or proximate the face can inhibit the flexure of the face and sole, thereby compromising ball speed.

There is a need in the art for an iron-type club head with features that achieve a low and forward CG location in a cost-effective, easily manufacturable, and efficient manner, wherein the features providing the desirable CG location do not compromise the flexibility of the club head.

BRIEF DESCRIPTION OF THE DRAWINGS

To facilitate further description of the embodiments, the following drawings are provided in which.

DEFINITIONS

Figure 1:
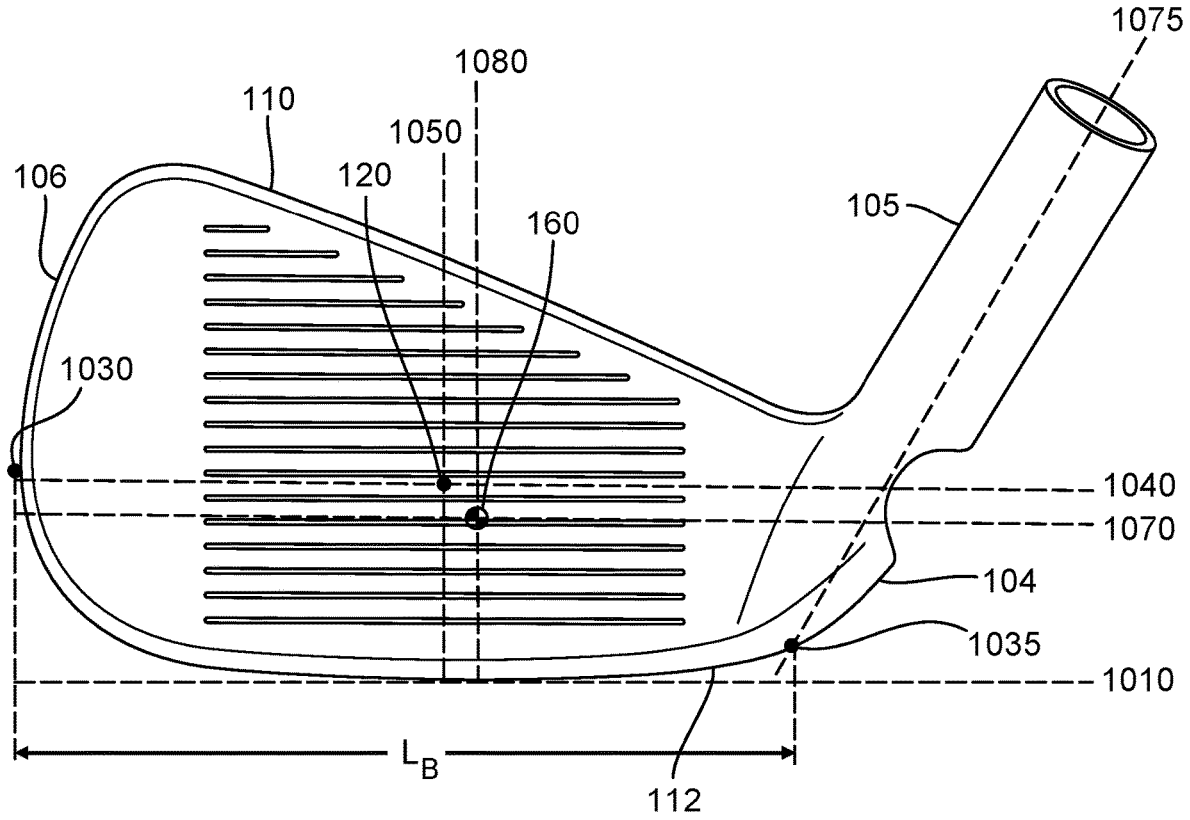
FIG. 1 illustrates a front view of a golf club head comprising a suspended weight bar.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "strike face," as used herein, refers to a club head front surface that is configured to strike a golf ball. The term strike face can be used interchangeably with the term "face."

The term "strike face perimeter," as used herein, can refer to an edge of the strike face. The strike face perimeter can be located along an outer edge of the strike face where the curvature deviates from a bulge and/or roll of the strike face.

The term "geometric centerpoint," or "geometric center" of the strike face, as used herein, can refer to a geometric centerpoint of the strike face perimeter, and at a midpoint of the face height of the strike face. In the same or other examples, the geometric center point also can be centered with respect to an engineered impact zone, which can be defined by a region of grooves on the strike face. As another approach, the geometric centerpoint of the strike face can be located in accordance with the definition of a golf governing body such as the United States Golf Association (USGA).

Figure 2:
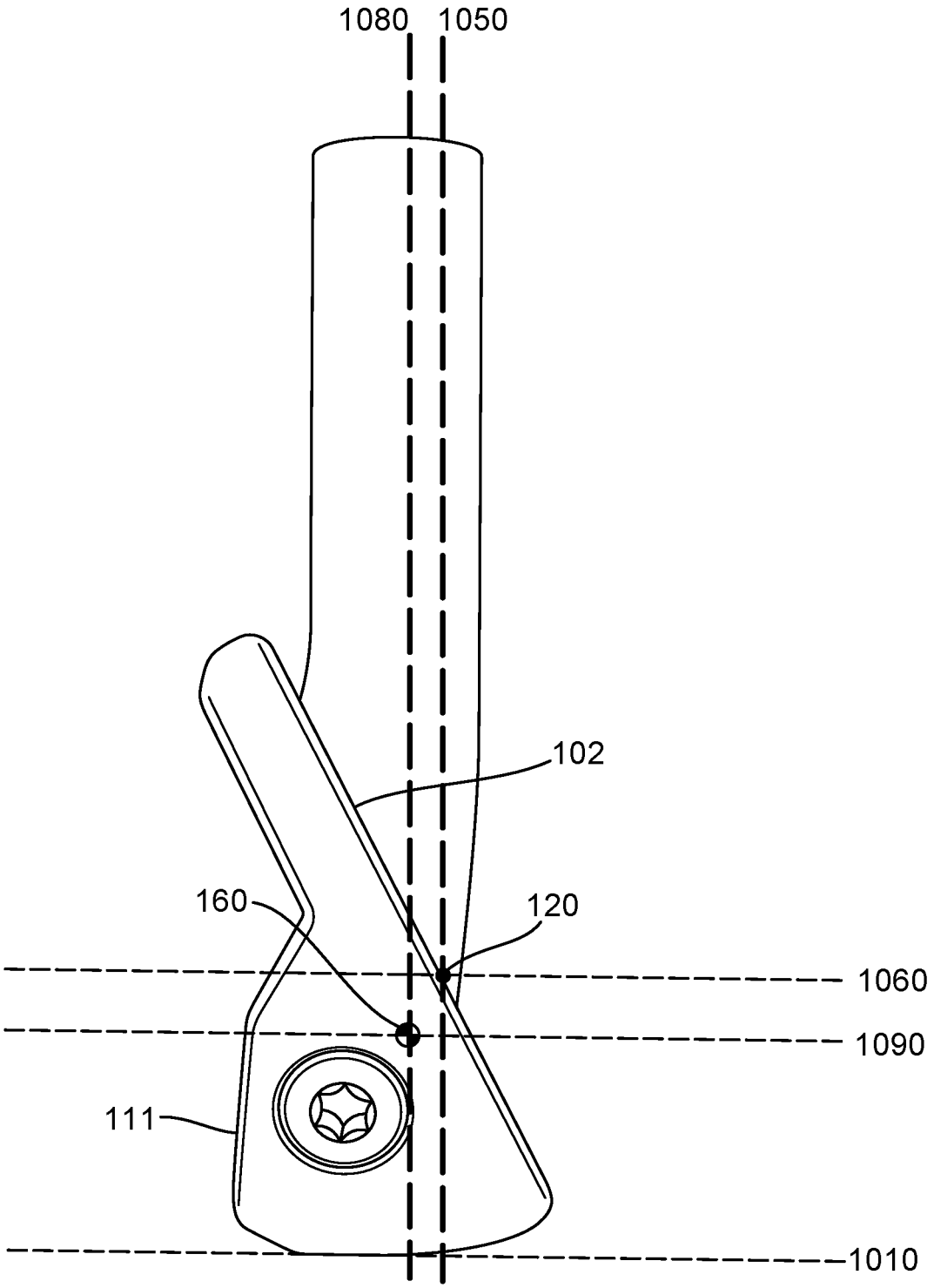
FIG. 2 illustrates a toe-side view of the golf club head of FIG. 1.
Figure 3:
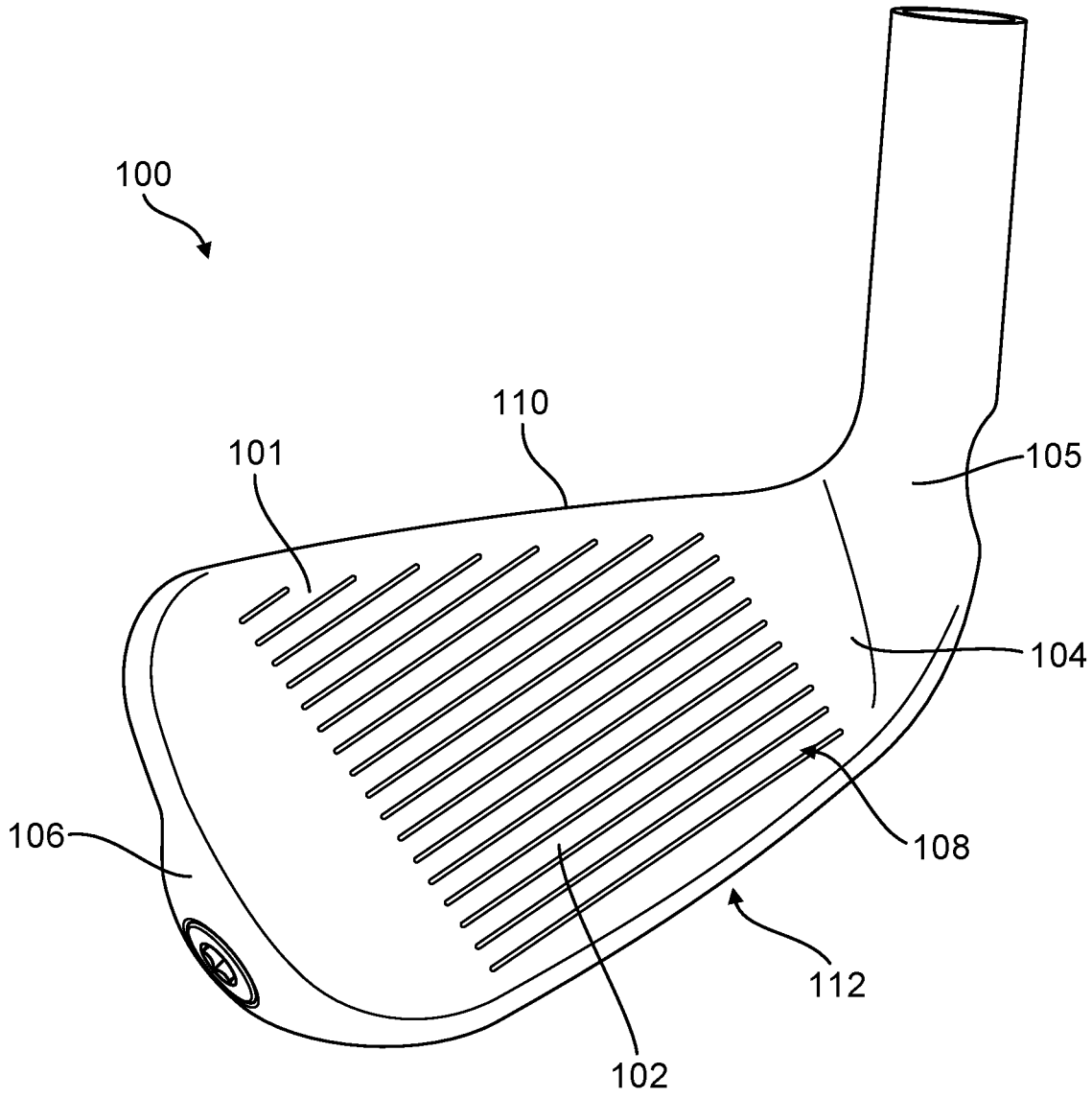
FIG. 3 illustrates a front-perspective view of the golf club head of FIG. 1.
Figure 4:
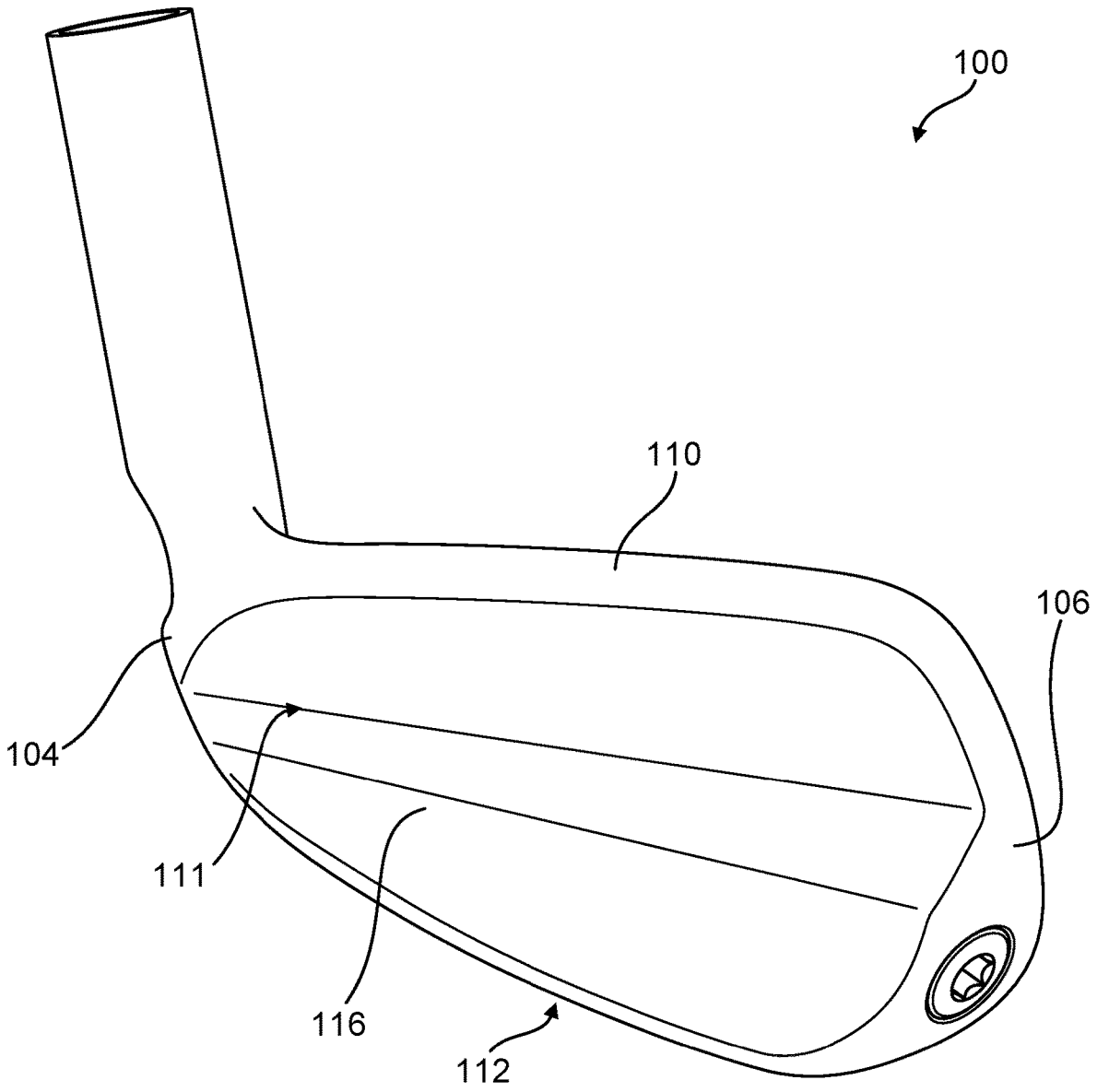
FIG. 4 illustrates a rear-perspective view of the golf club head of FIG. 1.

The term "ground plane," as used herein, can refer to a reference plane associated with the surface on which a golf ball is placed. Referring to FIGS. 1 and 2, the ground plane 1010 can be a horizontal plane tangent to the sole at an address position.

The term "loft plane," as used herein, can refer to a reference plane that is tangent to the geometric centerpoint of the strike face.

The term "loft angle," as used herein, can refer to an angle measured between the loft plane and the XY plane (defined below).

The term "face height," as used herein, can refer to a distance measured parallel to the loft plane, between a top end of the strikeface perimeter and a bottom end of the strikeface perimeter.

The "depth" of the golf club head, as described herein, can be defined as a front-to-rear dimension of the golf club head.

The "height" of the golf club head, as described herein, can be defined as a top rail-to sole dimension of the golf club head. In many embodiments, the height of the club head can be measured according to a golf governing body such as the United States Golf Association (USGA).

The "length" of the golf club head, as described herein, can be defined as a heel-to-toe dimension of the golf club head. In many embodiments, the length of the club head can be measured according to a golf governing body such as the United States Golf Association (USGA).

The "blade length" ($L_B$) of the golf club head, as illustrated in FIG. 1 and described herein, can be defined as a heel-to-toe distance between a toe-most point 1030 of the club head and an intersection point 1035 between the hosel axis 1075 and the sole.

The "geometric center height" of the fairway-type golf club head, as described herein, is a height measured perpendicular from the ground plane to the geometric centerpoint of the golf club head.

The "leading edge" of the club head, as described herein, can be identified as the most sole-ward portion of the strike face perimeter.

As illustrated in FIGS. 1 and 2, the club head can define a primary coordinate system centered about the geometric center 120 of the strike face. The primary coordinate system can comprise an X-axis 1040, a Y-axis 1050, and a Z-axis 1060. The X-axis 1040 can extend in a heel-to-toe direction. The X-axis 1040 can be positive towards the heel end 104 and negative towards the toe end 106. The Y-axis 1050 can extend in a top rail-to-sole direction and can be orthogonal to both the Z-axis 1060 and the X-axis 1040. The Y-axis 1050 can be positive towards the top rail 110 and negative towards the sole 112. The Z-axis 1060 can extend in front-to-rear direction, parallel to the ground plane 1010 and can be orthogonal to both the X-axis 1040 and the Y-axis 1050. The Z-axis 1060 can be positive towards the strike face 102 and negative towards the rear end 111.

The term or phrase "center of gravity position" or "CG location" can refer to the location of the club head center of gravity (CG) 162 with respect to the primary coordinate system, wherein the CG position is characterized by locations along the X-axis 1040, the Y-axis 1050, and the Z-axis 1060. The term "CGx" can refer to the CG location along the X-axis 1040, measured from the geometric center 120. The term "CG height" can refer to the CG location along the Y-axis 1050, measured from the geometric center 120. The term "CGy" can be synonymous with the CG height. The term "CG depth" can refer to the CG location along the Z-axis 1060, measured from the geometric center 120. The term "CGz" can be synonymous with the CG depth.

The primary coordinate system of the golf club head, as described herein defines an XY plane extending through the X-axis 1040 and the Y-axis 1050. The coordinate system defines XZ plane extending through the X-axis 1040 and the Z-axis 1060. The coordinate system further defines a YZ plane extending through the Y-axis 1050 and the Z-axis 1060. The XY plane, the XZ plane, and the YZ plane are all perpendicular to one another and intersect at the coordinate system origin located at the geometric center 120 of the strike face. In these or other embodiments, the golf club head can be viewed from a "front view" when the strike face is viewed from a direction perpendicular to the XY plane. Further, in these or other embodiments, the golf club head can be viewed from a "side view" or side cross-sectional view when the heel is viewed from a direction perpendicular to the YZ plane.

Further, referring to FIGS. 1 and 2, the golf club head comprises a secondary coordinate system centered about the center of gravity 162. The coordinate system comprises an X'-axis 1070, a Y'-axis 1080, and a Z'-axis 1090. The X'-axis 1070 extends in a heel-to-toe direction. The X'-axis 1070 is positive towards the heel 104 and negative towards the toe 106. The Y'-axis 1080 extends in a sole-to-top rail direction and is orthogonal to both the Z'-axis 1090 and the X'-axis 1070. The Y'-axis 1080 is positive towards the top rail 110 and negative towards the sole 112. The Z'-axis 1090 extends front-to-rear, parallel to the ground plane 1010 and is orthogonal to both the X'-axis 1070 and the Y'-axis 1080. The Z'-axis 1090 is positive towards the strike face 102 and negative towards the rear end 111.

The term or phrase "moment of inertia" (hereafter "MOI") can refer to values measured about the CG 162. The term "MOIxx" or "Ixx" can refer to the MOI measured about the X'-axis 1070. The term "MOIyy" or "Iyy" can refer to the MOI measured about the Y'-axis 1080. The term "MOIzz" or "Izz" can refer to the MOI measured about the Z'-axis 1090. The MOI values MOIxx, MOIyy, and MOIzz determine how forgiving the club head is for off-center impacts with a golf ball.

The term "iron," as used herein, can, in some embodiments, refer to an iron-type golf club head having a loft angle that is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34, or less than approximately 33 degrees degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, or greater than approximately 32 degrees.

In some embodiments, the iron can comprise a total mass ranging between 180 grams and 260 grams, 190 grams and 240 grams, 200 grams and 230 grams, 210 grams and 220 grams, or 215 grams and 220 grams. In some embodiments, the total mass of the club head is 215 grams, 216 grams, 217 grams, 218 grams, 219 grams, or 220 grams.

DESCRIPTION

I. Club Head with Floating Weight Bar

Described herein is an iron-type golf club head comprising a suspended weight bar. The suspended weight bar provides the club head with a low and forward CG position without compromising the flexibility of the club head. The weight bar can be enclosed within the club head interior cavity and attached to an internal mass pad. The weight bar can be "suspended" in front of the mass pad such that the weight bar overhangs a portion of the sole and moves the CG toward a low, forward portion of the club head. The weight bar can be located in a low and forward portion of the interior cavity yet spaced away (not touching when the club is at rest) from the strike face and the sole. The spacing between the weight bar, the strike face, and sole allows the strike face and sole to flex and transfer a maximum amount of energy to the golf ball.

The weight bar is separately formed from the club head body and attached thereto. Separate formation of the weight bar allows the weight bar to comprise a complex geometry, providing a more aggressive low and forward CG placement than an integrally cast weighting system. Separately forming the weight bar and the body also provides the ability to optimize material selection of the weight bar. For example, the weight bar can be formed of a material that is cheaper or has improved properties over the material of the body.

The weight bar is discontinuously attached to the club head body such that weight bar attaches to the body at a limited number of discrete attachment locations. In many embodiments, the weight bar is discontinuously attached to the mass pad at a plurality of discrete attachment locations. As such, one or more gaps can be formed between the mass pad and the weight bar. The discontinuous engagement between the weight bar and the body provides a more efficient placement of mass. Providing the gaps saves mass proximate the mass pad and allows more mass to be distributed low and forward in the club head or weight bar.

As discussed above, the weight bar produces a club head with an aggressive low and forward CG position. In many embodiments, the club head comprising a suspended weight bar can lower the CG by more than 10% and bring the CG more than 10% forward in comparison to a similar club head devoid of the weight bar. For an iron-type club head, this low and forward CG improves club head performance. In particular, a lower and more forward CG can lead to increases in ball speed, launch angle, and back spin (hereafter referred to as "spin" or "spin rate"). The combination of an increased ball speed, launch angle, and spin rate produces golf shots that travel further and have improved stopping power.

A. Club Head Body

Described herein are various embodiments of a club head comprising a suspended weight bar within an interior cavity of the golf club head. The general features and characteristics of the club head will be illustrated on club head 100, illustrated in FIGS. 1-8. The features discussed below in relation to club head 100 are applicable to various embodiments of club heads according to the present invention. Any one or more of the features described in the various embodiments below can be used in combination with one another.

Figure 5:
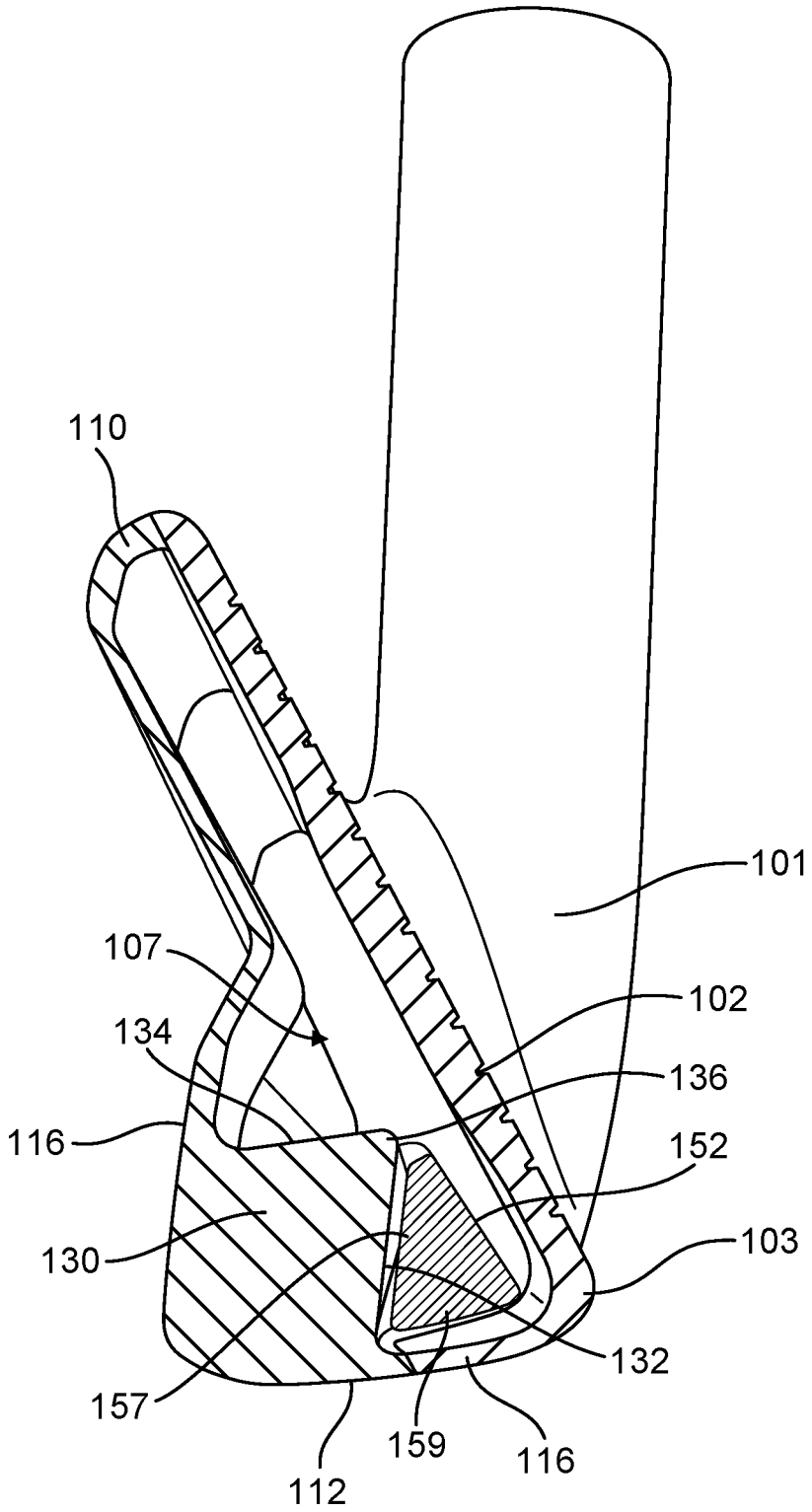
FIG. 5 illustrates a cross-sectional view of the golf club head of FIG. 1.

As illustrated in FIGS. 1-8, the club head 100 is an iron-type club head that comprises a body 101 with a front end 108 forming a strike face 102, a rear end 111 opposite the front end 108 and forming a rear wall 116, and a top rail 110, a sole 112, a heel end 104, and a toe end 106 each extending between the front end 108 and the rear end 111. Further, the club head 100 comprises a hosel 105 extending upward from the heel end 104. Referring to FIG. 5, the club head 100 comprises a hollow body construction, wherein the strike face 102, top rail 110, sole 112, heel end 104, toe end 106, and rear wall 116 all combine to enclose a hollow interior cavity 107. The body 101 forms an integral mass pad 130 within the interior cavity 107. The mass pad 130 can be in a low and rearward portion of the interior cavity 107, such that the mass pad 130 is integral with at least a portion of the sole 112 and at least a portion of the rear wall 116. In many embodiments, as illustrated in FIG. 5, the mass pad 130 extends upward from a rear portion of the sole 112 and outward from a lower portion of the rear wall 116. Further, the mass pad 130 can extend at least a majority of the distance between the heel end 104 and the toe end 106. The mass pad 130 serves to concentrate a large amount of mass low in the club head 100, thereby lowering the center of gravity 160 position.

In many embodiments, the mass pad 130 can comprise a relatively simple geometry that is easy to cast. In the embodiment illustrated in FIG. 5, the mass pad 130 comprises a front wall 132 facing the front end 108, a top wall 134 facing the top rail 110, and a transition region 136 between the front wall 132 and the top wall 134. In some embodiments, the front wall 132 can be angled towards the front end 108, such that the transition region 136 is closer to the strike face 102 than the base of the front wall 132. Angling the front wall 132 towards the front end can serve to provide a slightly more forward CG position. In other embodiments, the front wall 132 can be substantially parallel to the strike face 102 or angled rearward from the strike face 102.

As further illustrated in FIG. 5, the club head 100 can comprise a thin sole portion 118 having a minimum thickness ranging from 0.035 inch to 0.070 inch. The thin sole portion 118 forms a forward portion of the sole 112 between the strike face 102 and the mass pad 130. In the present embodiment, the thin sole portion 118 extends from the leading edge 103 to the base of the mass pad 130. The thin sole portion 118 provides an area of increased flexibility on the sole 112 proximate the strike face 102. Providing a significant thin sole portion 118 allows the sole 112 to flex at impact, returning more internal energy to the golf ball and increasing ball speed.

The thin sole portion 118 is significantly thinner than the portions of the sole 112 formed by the mass pad 130. The thin sole portion 118 can comprise a thickness measured from an exterior surface of the sole 112 to an interior surface of the thin sole portion 118 facing the interior cavity. In some embodiments, the thin sole portion 118 comprises a minimum thickness between 0.035 and inch. In some embodiments, the minimum thickness of the thin sole portion 118 can be less than 0.070 inch, less than 0.065 inch, less than 0.060 inch, less than 0.055 inch, less than 0.050 inch, less than 0.045 inch, less than 0.040 inch, or less than 0.035 inch.

The mass pad 130 can be located rearward of the thin sole portion 118, so as not to interfere with the flexure of the sole 112. In many embodiments, the base of the mass pad 130 is spaced as far as possible from the strike face 102. Spacing the base of the mass pad 130 rearward of the strike face 102 allows for providing the most significant thin sole portion 118. Doing so balances the flexure and ball speed benefits of the thin sole portion 118 with the CG placement benefits of the mass pad 130. In many embodiments, referring now to FIG. 6, the thin sole portion 118 can be characterized by a thin sole portion length $L_{TS}$. The thin sole portion length $L_{TS}$ is measured as the front-to-back distance, parallel to the Z-axis 1060, between the leading edge 103 and the base of the mass pad 130. In many embodiments, the thin sole portion length $L_{TS}$ is greater than 0.050 inch, greater than 0.075 inch, greater than 0.100 inch, greater than 0.125 inch, greater than 0.150 inch, greater than 0.175 inch, greater than 0.200 inch, greater than 0.225 inch, or greater than 0.250 inch.

Figure 7:
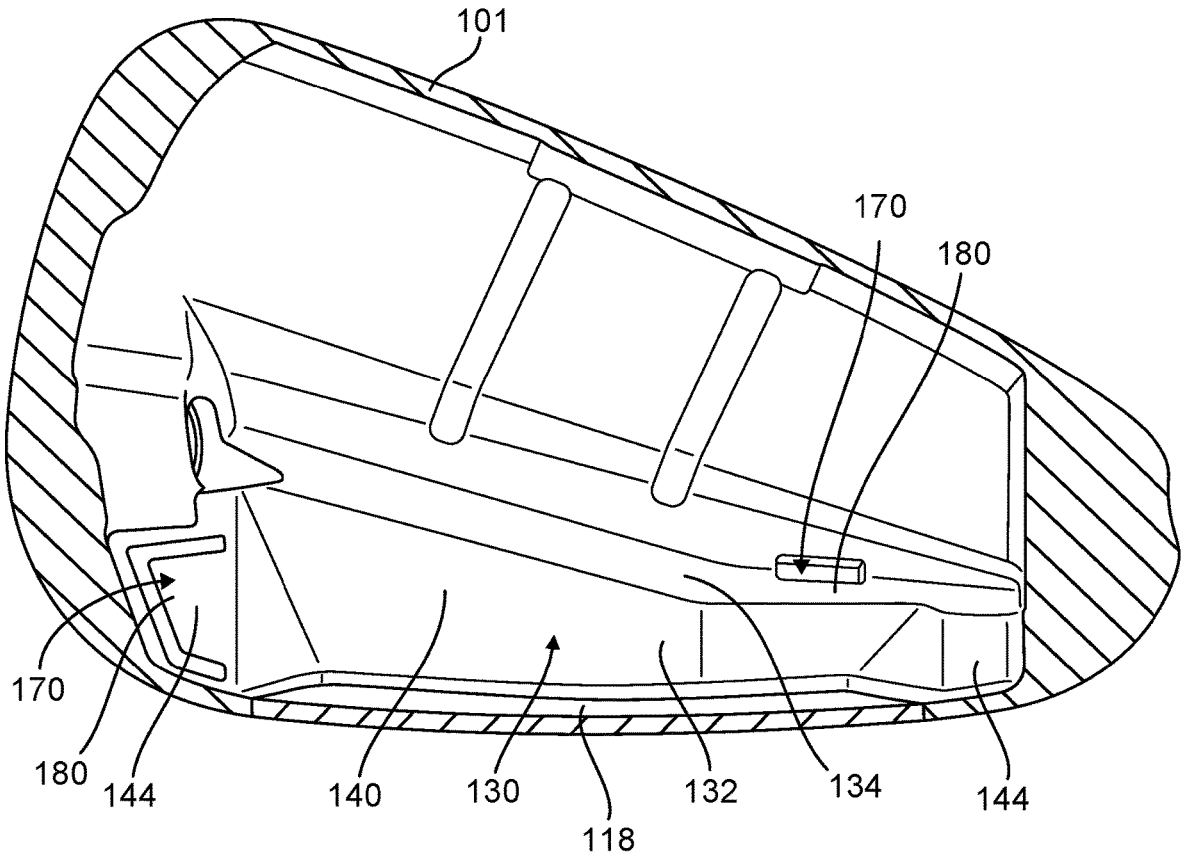
FIG. 7 illustrates a front cross-sectional view of the golf club head of FIG. 1, with the suspended weight bar removed to highlight the geometry of an internal mass pad.

Referring to FIG. 7, the mass pad 130 comprises a mass pad central portion 140, a heel mass 142 and a toe mass 144. The mass pad central portion 140 is formed integrally with at least a portion of the sole 112 and at least a portion of the rear wall 116. The heel mass 142 is formed integrally with at least a portion of the heel end 104, at least a portion of the rear wall 116, and at least a portion of the sole 112. Likewise, the toe mass 144 is formed integrally with at least a portion of the toe end 106, at least a portion of the rear wall 116, and at least a portion of the sole 112. In the illustrated embodiment, mass pad central portion 140 occupies only a central portion of the interior cavity 107. The heel mass 142 and the toe mass 144 are located heel-ward and toe-ward of the mass pad central portion 140, respectively. As such, the mass pad central portion 140 can be situated between the heel mass 142 and the toe mass 144.

The heel mass 142 and toe mass 144 can extend forward of the mass pad central portion 140. In particular, portions of the heel mass 142 and toe mass 144 can extend closer to the strike face 102 than the mass pad front wall 132. The heel mass 142 and the toe mass 144 provide perimeter weighting to increase the club head MOI and brings the CG forward without restricting the flexure of the sole 112. The heel mass 142 and toe mass 144 are located proximate the heel end 104 and toe end 106, respectively, and away from the center of the club head 100. The heel mass 142 and toe mass 144 do not need to be spaced as far away from the strike face 102 as the mass pad central portion 140. The flexure of the sole 112 near the heel end 104 and toe end 106 is not as critical as the flexure of the sole 112 near the center of the club head 100. In other words, the sole portion length $L_{TS}$ can be shorter proximate the heel and toe masses 142, 144 than proximate the mass pad 130.

B. Weight Bar

Referring to FIGS. 5-8, the club head 100 further comprises a weight bar 150. The weight bar 150. The weight bar 150, in many embodiments, is a component that is formed separately from the body 101 and attached thereto. In many embodiments, the weight bar 150 is enclosed entirely within the interior cavity 107 and is not visible from the exterior of the club head 100. The weight bar 150 can be attached to one or more internal surfaces of the club head 100 (i.e. the internal surfaces of the heel end 104, toe end 106, sole 112, rear wall 116, top rail 110, or mass pad 130 that bound the interior cavity 107). In many embodiments, the weight bar 150 can be attached to the body 101 via a welding or brazing process. In other embodiments, the weight bar 150 can be attached to the body 101 by mechanical means, such as by one or more mechanical fasteners, or by any other suitable joining means. By forming the weight bar 150 and body 101 separately, the weight bar 150 can be formed to achieve desirable shaping and tolerances while maintaining manufacturability. For example, the separately formed weight bar 150 can comprise a shape that is not suitable to be integrally cast or formed with the body 101. Thus, the separate formation of the weight bar 150 allows for more complex geometries, resulting in more aggressive CG placement, than an integrally cast system.

Further, separately forming the weight bar 150 and the body 101 can be advantageous by providing the ability to optimize material selection. In many embodiments, the weight bar 150 can be formed of the same or similar material as the body 101. However, in other embodiments, the weight bar 150 can be formed of a different material than the body 101. The material of the weight bar 150 can be selected based on manufacturability, cost, performance considerations, or any combination thereof. In some embodiments, the weight bar 150 can comprise a material that has similar melting or welding properties to the body 101, allowing for a more secure weld that is easier to manufacture. In some embodiments, the weight bar 150 can comprise a lower-grade material or alloy than the remainder of the body 101. As discussed above, the weight bar 150 is concealed within the interior cavity 107, and therefore the lower-grade material is not visible to the player. The selection of a lower-grade material or alloy for the weight bar 150 may offer distinct advantages, such as reduced cost and increased material availability, without sacrificing manufacturability or aesthetics.

Alternatively, providing a separately formed weight bar 150 allows for the selection of a material distinct from the material of the body 101 and/or the strike face 102. Forming the weight bar 150 of a distinct material can provide additional performance benefits. For example, in many embodiments, the weight bar 150 can be formed of a higher-density material than the body 101. In such embodiments, the weight bar 150 can provide a lower or more forward CG position than a similar weight bar formed of the same material as the body 101.

In many embodiments, the body material can be a stainless steel, such as 17-4 stainless steel. In other embodiments, the body material can be a steel or stainless steel alloy such as 15-5 stainless steel, 431 stainless steel, 4140 steel, 4340 steel, or any other suitable material. The body material can comprise a density between 7.0 g/cm$^3$ and 10.0 g/cm$^3$. In some embodiments, the body material can comprise a density between 7.0 g/cm$^3$ and 7.5 g/cm$^3$, between 7.5 and 8.0 g/cm$^3$, between 8.0 and 8.5 g/cm$^3$, between 8.5 and 9.0 g/cm$^3$, between 9.0 and 9.5 g/cm$^3$, or between 9.5 and 10.0 g/cm$^3$.

In many embodiments, the material of the weight bar 150 can be a steel or stainless steel alloy the same or similar to that of the body 101, such as such as 15-5 stainless steel, 431 stainless steel, 4140 steel, 4340 steel. In some embodiments, the material of the weight bar 150 can be tungsten or a tungsten alloy with a greater density than the body material. In some embodiments, the weight bar 150 can be a tungsten-steel blend to achieve the desired weight bar density. The weight bar material can comprise a density between 7.0 and 20.0 g/cm$^3$. In some embodiments, the weight bar density can be greater than 7.0 g/cm$^3$, greater than 8.0 g/cm$^3$, greater than 9.0 g/cm$^3$, greater than 10.0 g/cm$^3$, greater than 11.0 g/cm$^3$, greater than 12.0 g/cm$^3$, greater than 13.0 g/cm$^3$, greater than 14.0 g/cm$^3$, greater than 15.0 g/cm$^3$, greater than 16.0 g/cm$^3$, greater than 17.0 g/cm$^3$, greater than 18.0 g/cm$^3$, greater than 19.0 g/cm$^3$, or greater than 20.0 g/cm$^3$. In some embodiments, the weight bar 150 can comprise a greater density than the body 101. In other embodiments, the weight bar 150 and the body 101 can comprise the same or similar densities.

In many embodiments, the weight bar 150 can comprise a mass between 10 and 30 grams. In some embodiments, the weight bar 150 can comprise a mass between 10 and 15 grams, between 11 and 16 grams, between 12 and 17 grams, between 13 and 18 grams, between 14 and 19 grams, between 15 and 20 grams, between 16 and 21 grams, between 17 and 22 grams, between 18 and 23 grams, between 19 and 24 grams, between 20 and 25 grams, between 21 and 26 grams, between 22 and 27 grams, between 23 and 28 grams, between 24 and 29 grams, or between 25 and 30 grams.

In some embodiments, the weight bar 150 can comprise a multi-material structure. In some embodiments, one or more portions of the weight bar 150 can be made of a first material comprising a first density while another portion is made of a second material comprising a second density greater than the first density. In some embodiments, the higher-density second material can form a low and/or forward portion of the weight bar 150 to provide the club head with a more aggressive low and forward CG 160 position. In other embodiments, the weight bar 150 can comprise the higher-density second material proximate the weight bar heel end 104 and/or the weight bar toe end 106 to increase perimeter weighting, thereby increasing MOI. The variable density of the weight bar 150 in such embodiments can be achieved by forming separate weight bar pieces that are coupled together via welding or brazing. In other embodiments, a variable density weight bar 150 via a 3D printing process that creates a variable-density structure.

The weight bar 150 is suspended within the interior cavity 107, such that the weight bar 150 overhangs the sole 112. The weight bar 150 can be located in a low and forward portion of the interior cavity 107 without contacting any portion of the strike face 102 or sole 112. Providing the weight bar 150 in a low and forward portion of the interior cavity 107. Suspending the weight bar 150 allows for an efficient and aggressive placement of the weight bar mass, allowing for a low and forward CG. The suspended weight bar 150 provides the low and forward CG position without compromising the flexure of the strike face 102 and sole 112 and without compromising the manufacturability of the club head 100.

Figure 6:
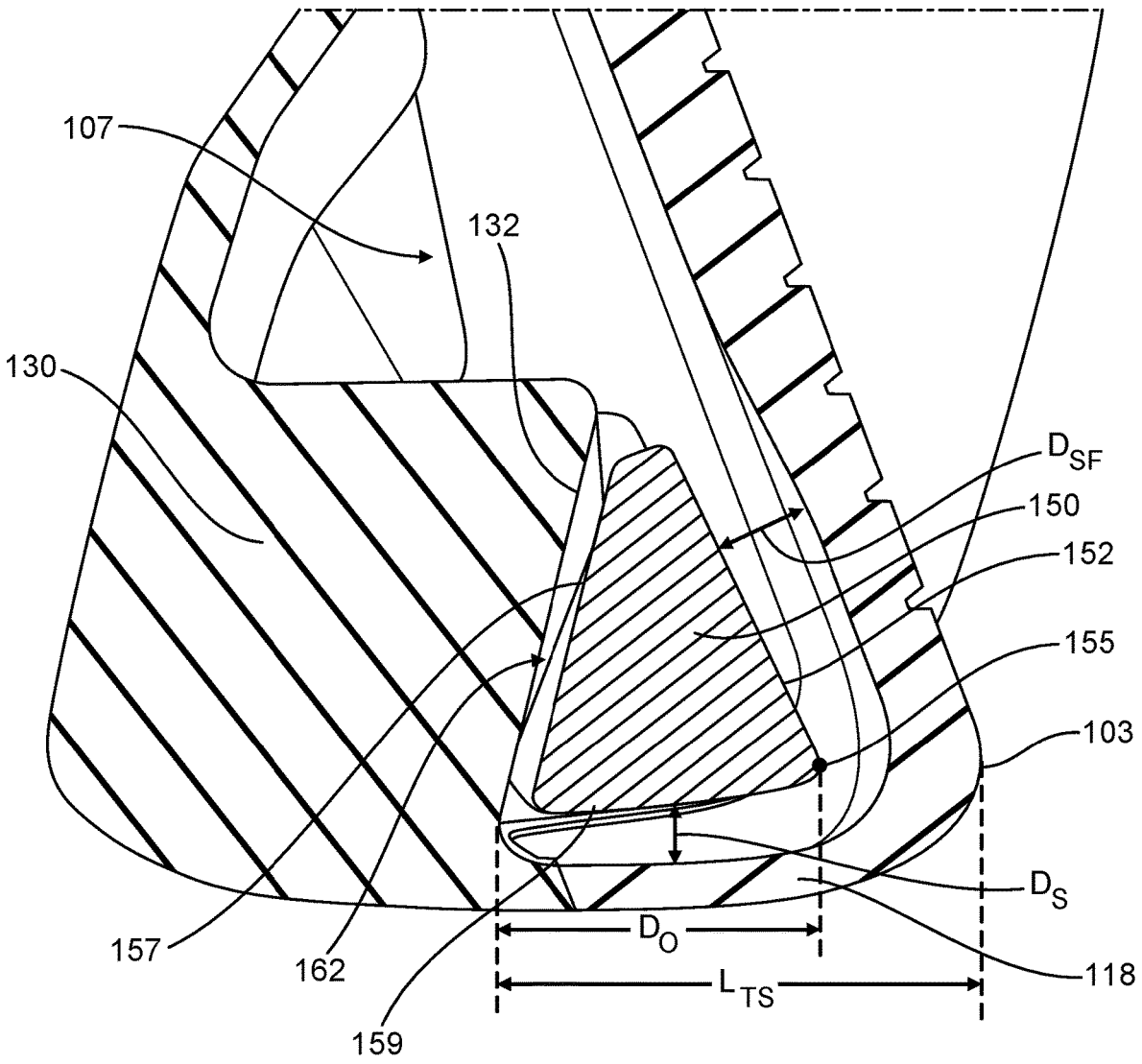
FIG. 6 illustrates a detail cross-sectional view of the golf club head of FIG. 1, highlighting the suspended weight bar.

Referring to FIG. 5, the weight bar 150 comprises at least a weight bar front surface 152 facing the strike face 102, a weight bar rear surface 157 facing rearward, and a weight bar bottom surface 159 facing the sole 112. As illustrated in FIG. 6, the weight bar front surface 152 can be spaced from the strike face 102, the weight bar bottom surface 159 can be spaced from the sole 112, and the weight bar rear surface 157 can be at least partially spaced from the mass pad 130. The spatial relationships between the weight bar surfaces 152, 157, 159 and portions of the body 101 are described in further detail below.

Figure 8:
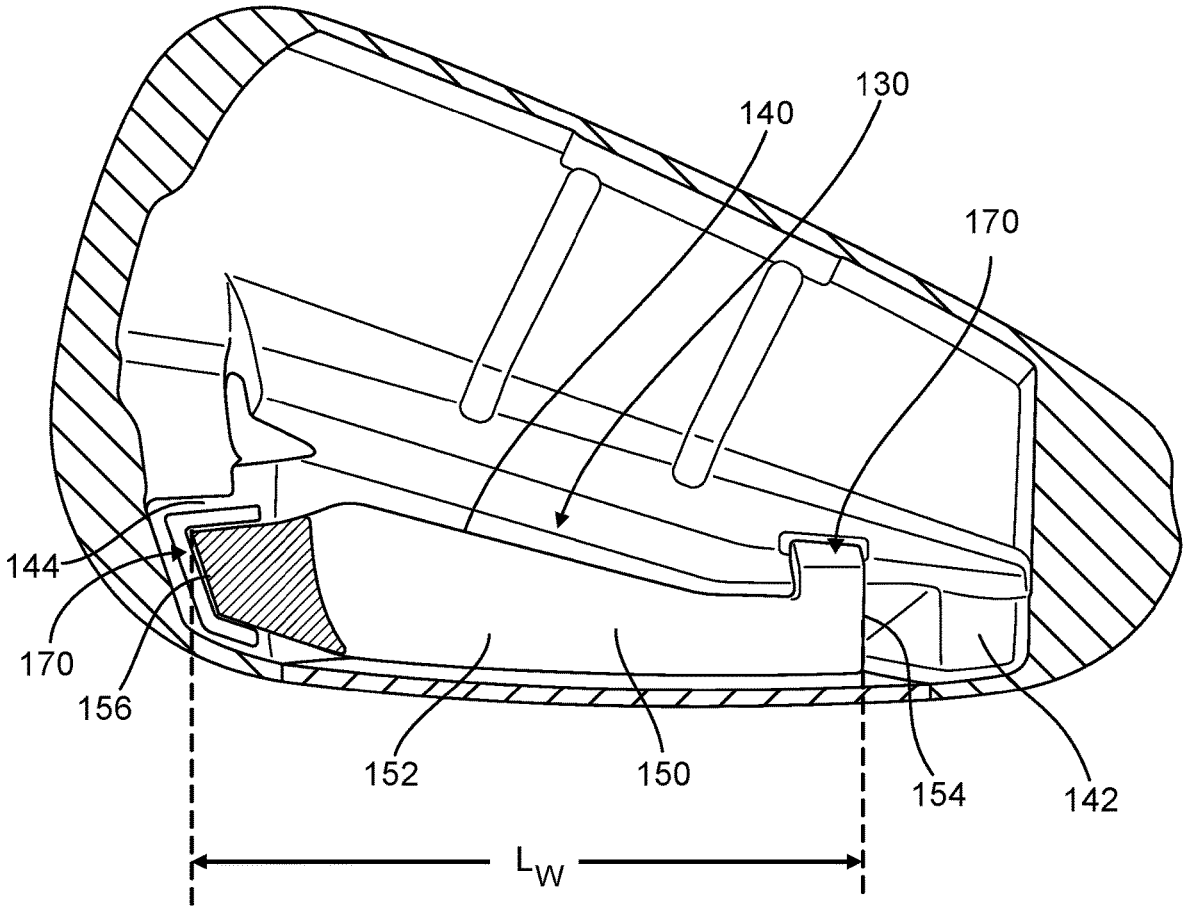
FIG. 8 illustrates the front cross-sectional view of FIG. 7, including the suspended weight bar.

Further, referring to FIG. 8, the weight bar 150 comprises a weight bar heel end 154 proximate the heel end 104 of the club head 100 and a weight bar toe end 156 proximate the toe end 106 of the club head 100. In many embodiments, the weight bar 150 can extend across a majority of the interior cavity 107 in a heel-to-toe direction. The weight bar 150 comprises a weight bar length $L_W$. The weight bar length $L_W$ is measured in the heel-to-toe direction, parallel to the X-axis 1040, between the weight bar heel end 154 and the weight bar toe end 156. In many embodiments, the weight bar length $L_W$ can be between 1.0 and 2.5 inches. In some embodiments, the weight bar length $L_W$ can be greater than 1.0 inch, greater than 1.25 inches, greater than 1.50 inches, greater than 1.75 inches, greater than 2.0 inches, greater than 2.25 inches, or greater than 2.5 inches. The weight bar length $L_W$ occupies a significant portion of the interior cavity 107. In addition to providing a low and forward CG, a substantially long weight bar 150 can provide perimeter weighting that increases the club head MOI.

In some embodiments, the weight bar length $L_W$ can be characterized in relation to the blade length $L_B$. In some embodiments the club head 100 can comprise ratio $L_W/L_B$ defined as the weight bar length divided by blade length $L_B$. In many embodiments, the ratio $L_W/L_B$ can be between 0.5 and 0.8. In some embodiments, the ratio $L_W/L_B$ can be greater than 0.5, greater than 0.55, greater than 0.6, greater than 0.65, greater than 0.7, greater than 0.75, or greater than 0.8.

As discussed above, the weight bar 150 is suspended within the interior cavity 107 and overhangs a portion of the sole 112. In many embodiments, the weight bar 150 is attached only to the mass pad 130, the heel mass 142, the toe mass 144, or a combination thereof. Referring to FIG. 6, the weight bar 150 can be attached such that the weight bar 150 hangs forward of the mass pad 130 (i.e. between the mass pad 130 and the strike face 102). The weight bar 150 hangs between the mass pad 130 and the strike face 102, above the thin sole portion 118. Referring to FIG. 8, the weight bar 150 can extend in a heel-to-toe direction along a significant portion of the mass pad length.

As illustrated in FIG. 6, the weight bar 150 overhangs the thin sole portion 118 by an overhang distance $D_O$. The overhang distance $D_O$ is a front-to-back distance, parallel to the Z-axis 1060, between a weight bar forwardmost point 155 and the base of the mass pad 130 (where the thin sole portion 118 terminates). In many embodiments, the overhang distance $D_O$ can be between 0.10 inch and 0.50 inch. In some embodiments, the overhang distance $D_O$ can be between 0.10 and 0.20 inch, between 0.15 inch and 0.25 inch, between 0.20 inch and 0.30 inch, between 0.25 inch and 0.35 inch, between 0.30 inch and 0.40 inch, between 0.35 inch and 0.45 inch, or between 0.40 inch and inch. In some embodiments, the overhang distance $D_O$ can be greater than 0.10 inch, greater than inch, greater than 0.20 inch, greater than 0.25 inch, greater than 0.30 inch, greater than 0.35 inch, greater than 0.40 inch, greater than 0.45 inch, or greater than 0.50 inch. The greater the overhang distance, the lower and more forward the CG can be placed without hindering the flexure of the thin sole portion 118.

Further, the weight bar 150 is suspended only at a discrete number of attachment locations. In other words, the weight bar 150 is not continuously attached to the body 101. The discrete attachment between the weight bar 150 and the body 101 provides a discontinuous engagement between the weight bar 150 and the body 101, wherein one or more gaps 162 are formed between portions of the weight bar 150 and the body 101. In many embodiments, one or more gaps 162 are provided between the weight bar 150 and the front wall 132 of the mass pad 130. The weight bar 150 can be attached to the mass pad 130 at two or more discrete attachment locations 170. In some embodiments, the weight bar 150 can be attached to the body 101 at two discrete attachment locations, three discrete attachment locations, four discrete attachment locations, five discrete attachment locations, or six or more discrete attachment locations. In some embodiments, the number of discrete attachment locations can be limited. In some embodiments, the weight bar 150 can be attached to the body 101 at six or less discrete attachment locations, five or less discrete attachment location, four or less discrete attachment locations, three or less discrete attachment locations, or two or less discrete attachment locations. In some embodiments, the discrete attachment locations can be spaced along the weight bar length $L_W$ in a heel-to-toe direction.

The number of gaps 162 can generally correspond to the number of discrete attachment locations 170. In many embodiments, such as the illustrated embodiment of FIG. 8, the weight bar 150 is attached at its ends 154, 156. In such embodiments, the number of gaps 162 can be equal to one less than the total number of discrete attachment locations 170, because every gap 162 is located between two adjacent discrete attachment locations 170. In other embodiments, the discrete attachment locations 170 can be inset from the weight bar ends 154, 156 and gaps 162 can be formed on the weight bar ends 154, 156. In such embodiments, one or more gaps 162 can be located between two adjacent discrete attachment locations 170, while the gaps 162 near the weight bar ends 154, 156 may be adjacent only at single discrete attachment location 170. In such embodiments, the number of gaps 162 can be one more than the total number of discrete attachment locations 170.

The weight bar 150 can be spaced away from the mass pad 130 between each of the discrete attachment locations, such that the weight bar 150 only contacts the body 101 at the discrete attachment locations. Referring to FIG. 6, one or more gaps 162 are formed between the mass pad front wall 132 and the weight bar rear surface 157. In many embodiments, the gaps 162 can be between 0.005 and 0.1 inch wide. In some embodiments, one or more of the gaps 162 can be between and 0.01 inch wide, between 0.01 and 0.02 inch wide, between 0.02 and 0.03 inch wide, between 0.03 and 0.04 inch wide, between 0.04 and 0.05 inch wide, between 0.05 and 0.06 inch wide, between 0.06 and 0.07 inch wide, between 0.07 and 0.08 inch wide, between 0.08 and 0.09 inch wide, or between 0.09 and 0.10 inch wide. In some embodiments, one or more of the gaps 162 can be greater than 0.005 inch wide, greater than 0.01 inch wide, greater than 0.02 inch wide, greater than inch wide, greater than 0.04 inch wide, greater than 0.05 inch wide, greater than 0.06 inch wide, greater than 0.07 inch wide, greater than 0.08 inch wide, greater than 0.09 inch wide, or greater than inch wide.

The discontinuous engagement between the weight bar 150 and the body 101 provides a more efficient placement of mass. For example, when comparing two weight bars of the same mass, providing gaps 162 between the mass pad front wall 132 and weight bar rear surface 157 allows the weight bar 150 to extend further forward toward the strike face 102 and place a higher concentration of weight towards the golf club head perimeter. More perimeter weighting can improve the golf club head MOI. As such, the weight bar 150 with a discontinuous attachment to the mass pad 130 can make more efficient use of the weight bar mass in providing a more forward CG position. Further, providing a discontinuous engagement between the weight bar 150 and the body 101 can provide manufacturing benefits. In welded embodiments, the weight bar 150 only needs to be welded at a number of discrete points, rather than continuously welded across the weight bar length $L_W$. Providing discrete attachment locations 170 thereby simplifies the welding process. Further, the structure of the discrete attachment locations 170 (described in further detail below) can act as installation guides, allowing for accurate and consistent placement of the weight bar 150.

Figure 9:
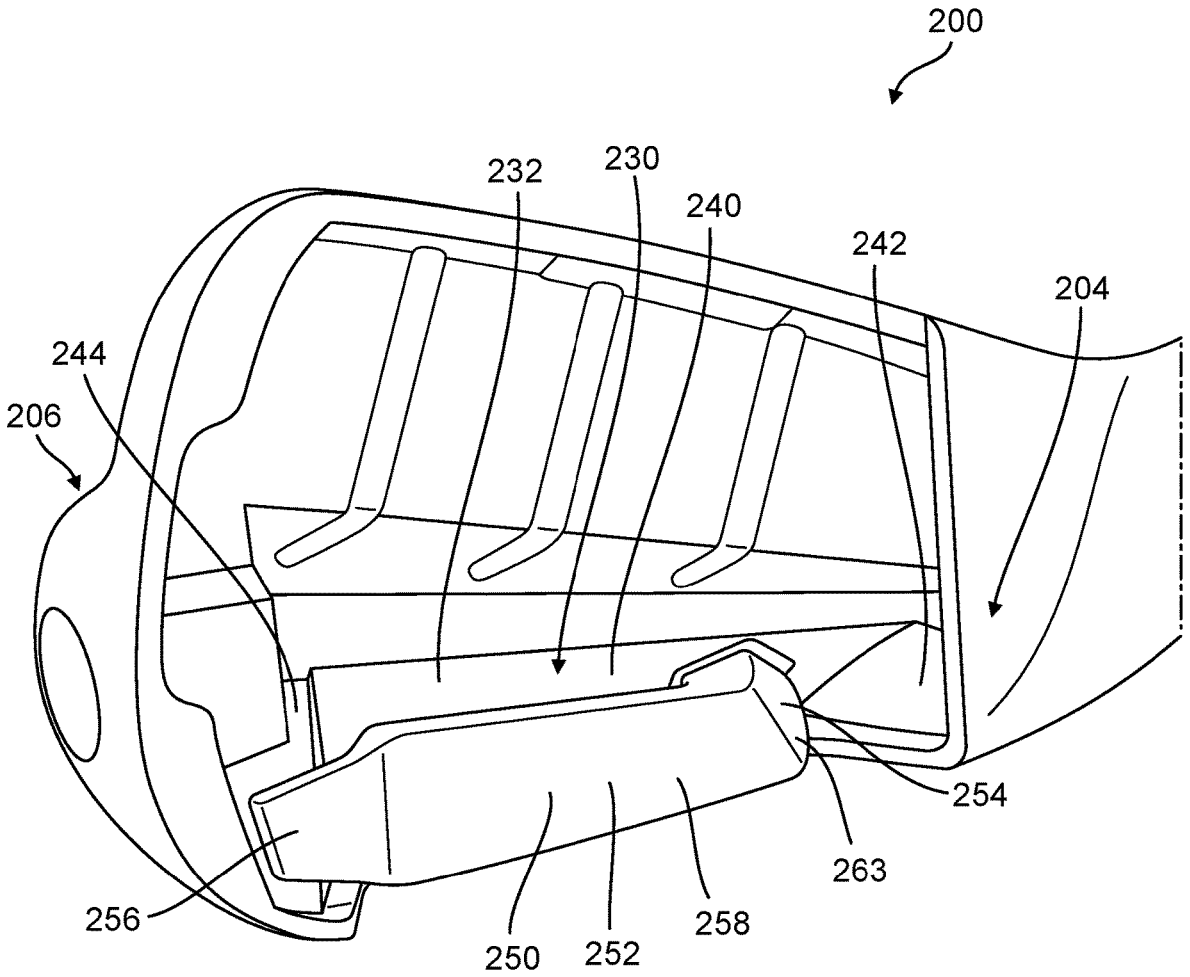
FIG. 9 illustrates a perspective view of a golf club head comprising a first embodiment of an L-shaped suspended weight bar, wherein the faceplate is removed.
Figure 10:
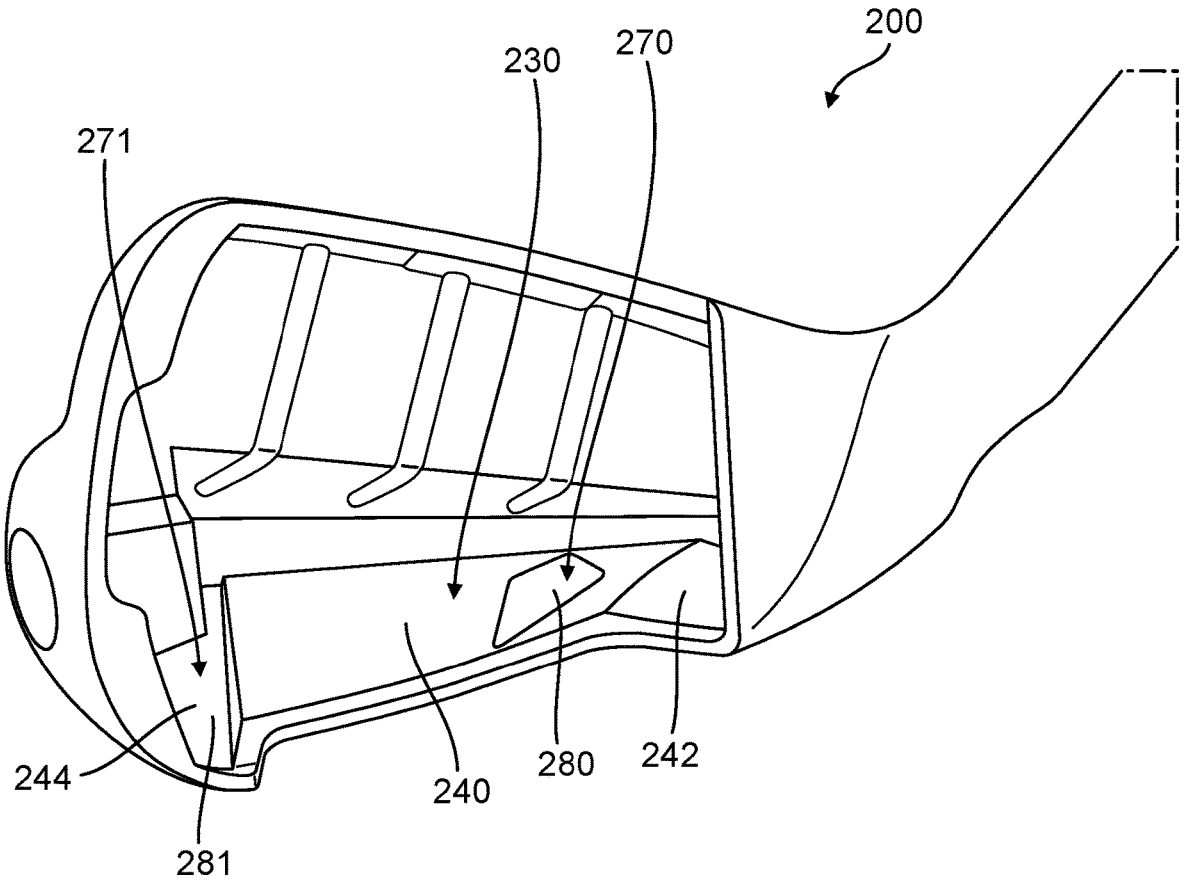
FIG. 10 illustrates the perspective view of FIG. 9, with the L-shaped suspended weight bar removed to highlight the geometry of an internal mass pad.
Figure 11:
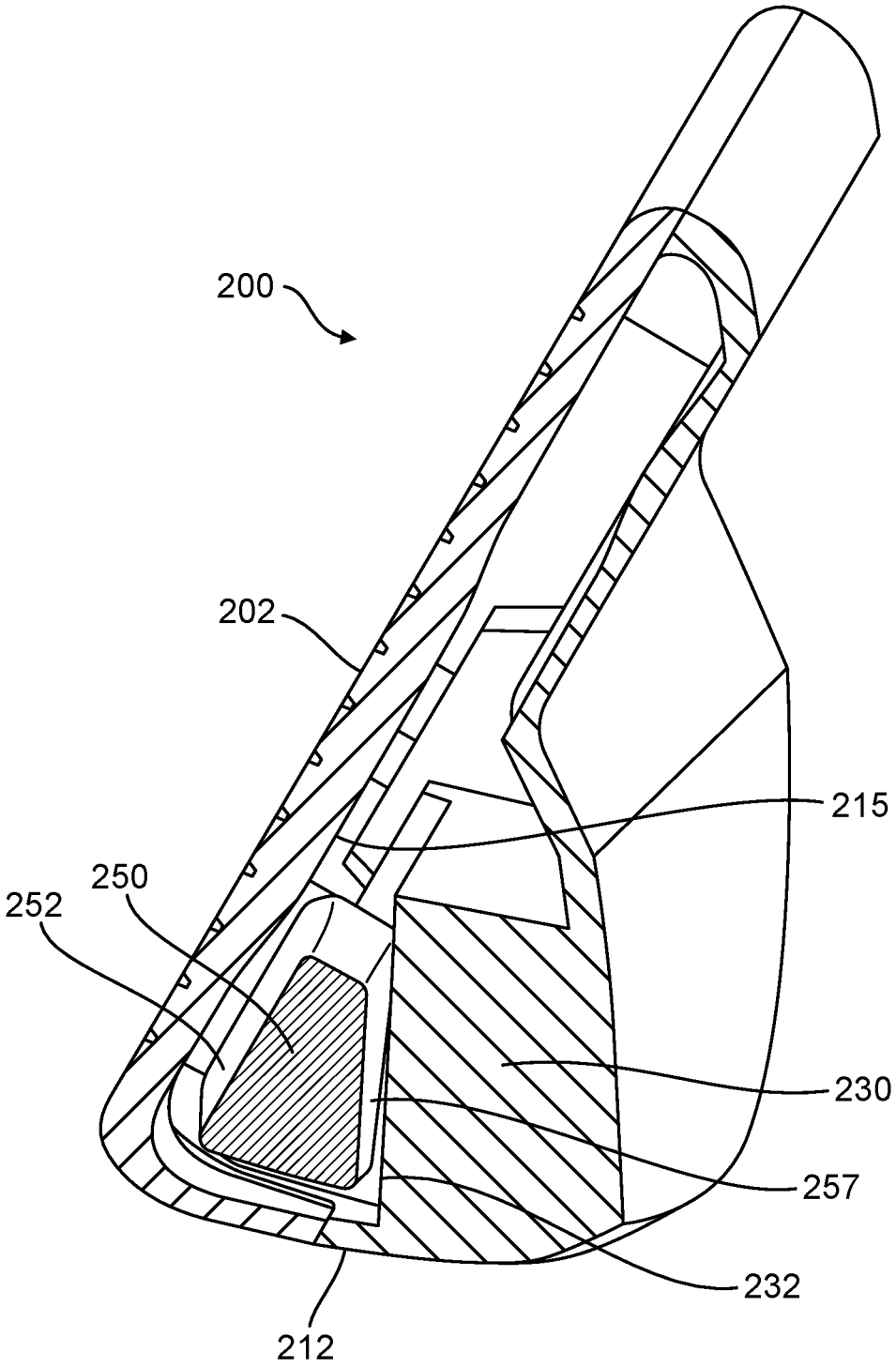
FIG. 11 illustrates a cross-sectional view of the golf club head of FIG. 9.
Figure 12:
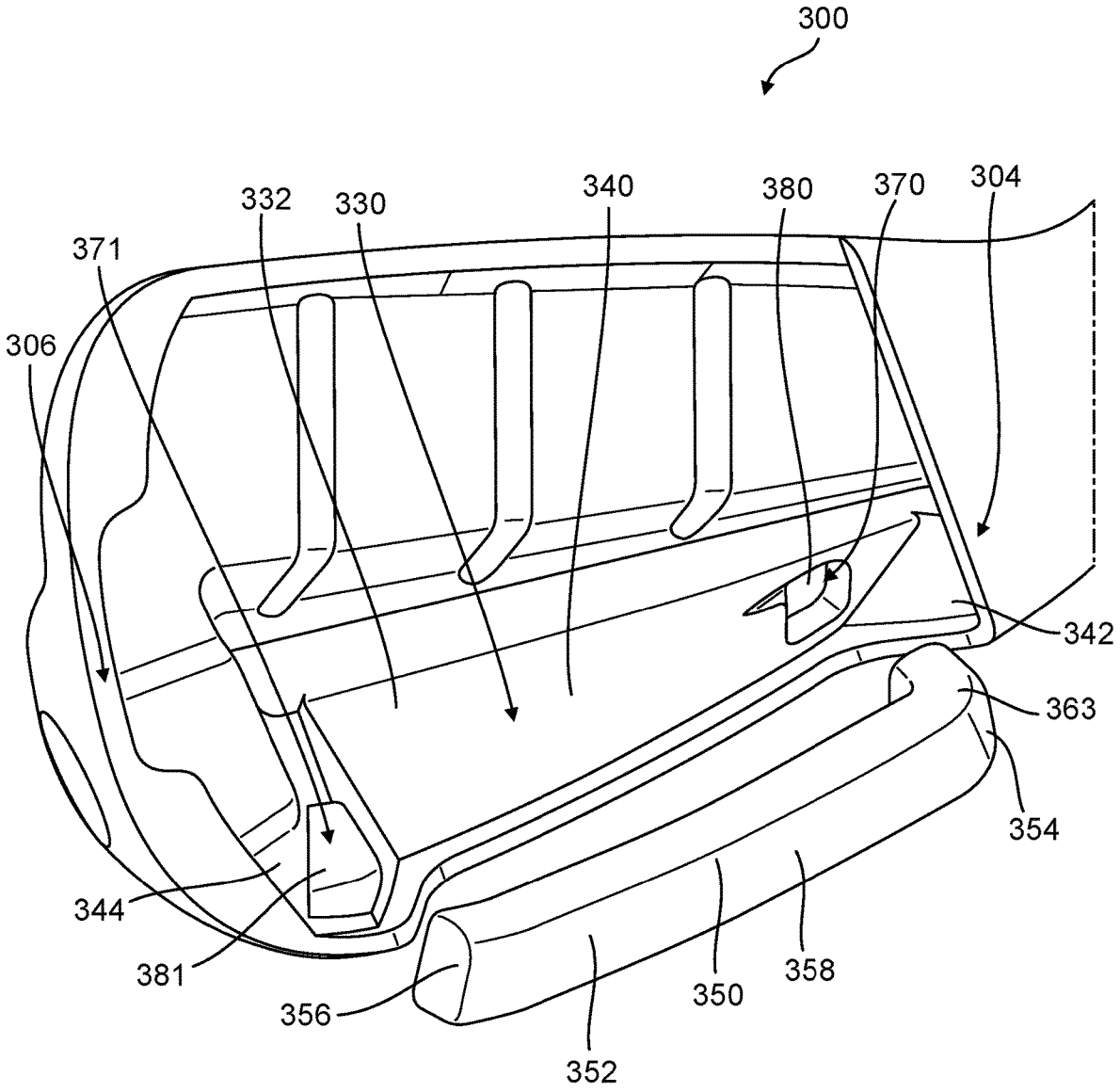
FIG. 12 illustrates a perspective, exploded view of a golf club head comprising a second embodiment of an L-shaped suspended weight bar, wherein the faceplate is removed.
Figure 13:
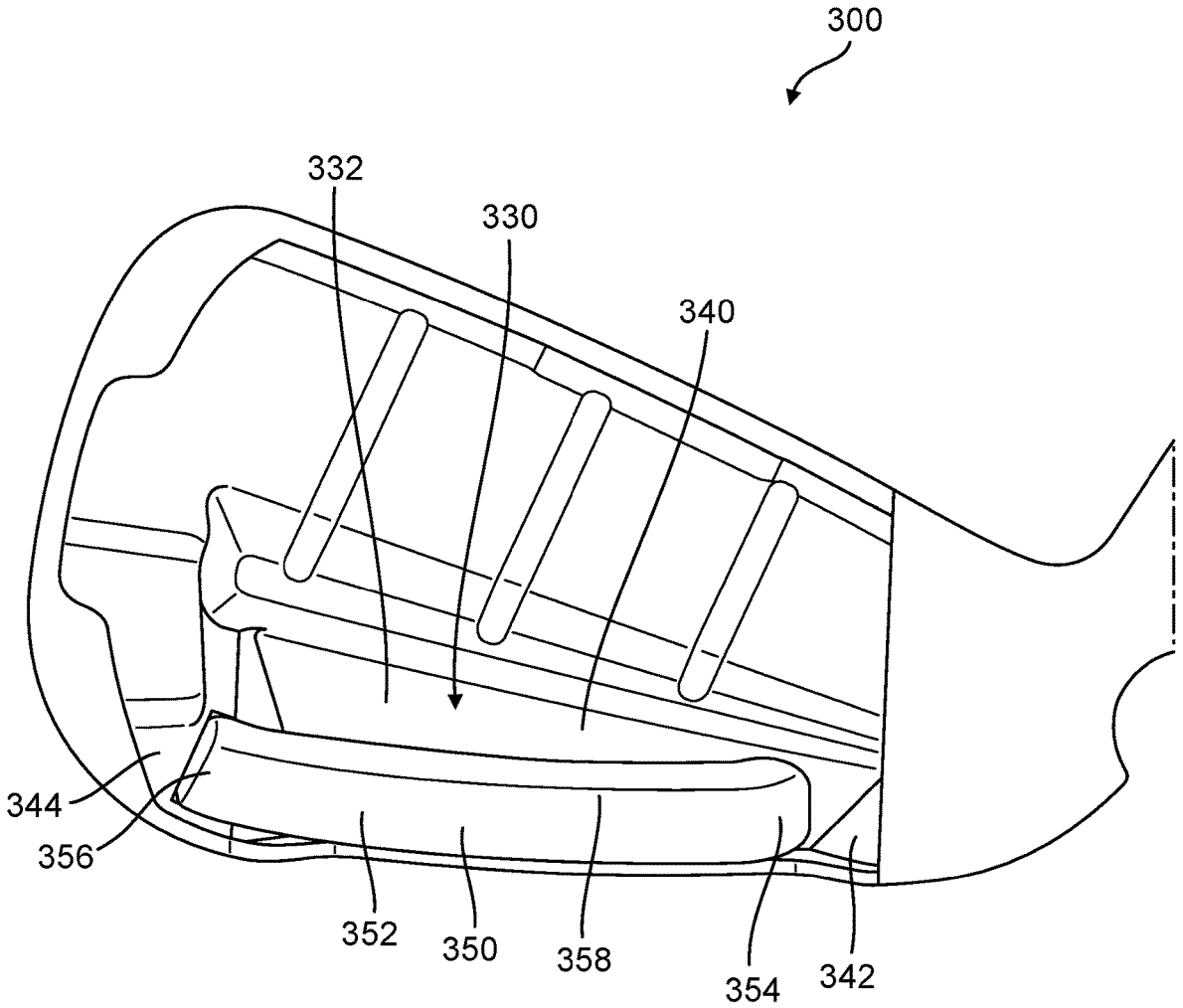
FIG. 13 illustrates a front view of the golf club head of FIG. 12, wherein the faceplate is removed.
Figure 14:
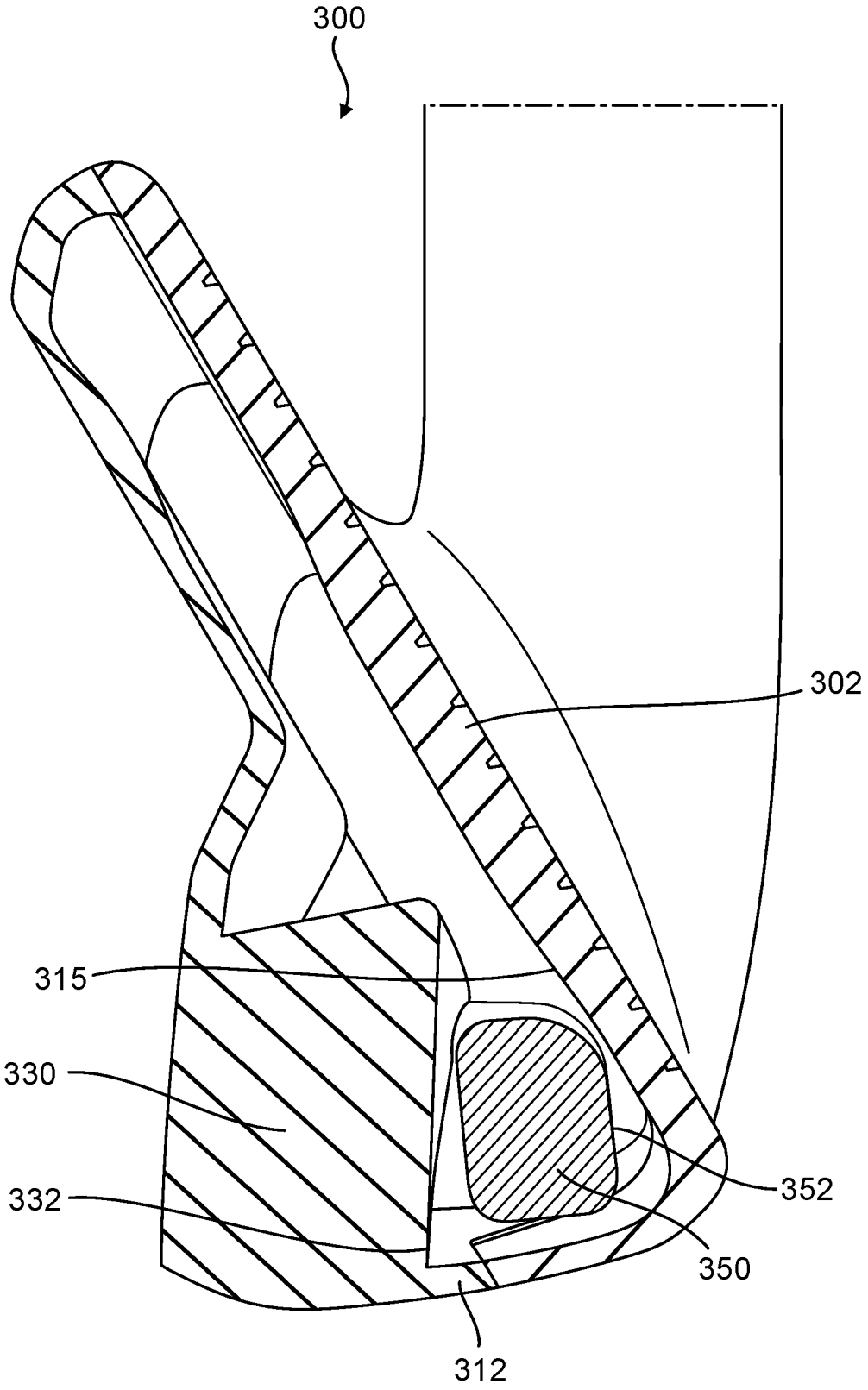
FIG. 14 illustrates a cross-sectional view of the golf club head of FIG. 12.

One or more attachment portions 180 can be formed at each of the discrete attachment locations 170. The one or more attachment portions 180 can be configured to receive the weight bar 150. In some embodiments, the attachment portions 180 can provide a simplified manufacturing process by helping to properly position the weight bar 150 during installation. In some embodiments, such as illustrated in FIG. 9-11, the attachment portion 180 can take the form of a mass build-up that extends slightly outward from the surface of the mass pad 130 at a given discrete attachment location 170. In such embodiments, the mass build up can form a surface raised relative to the surrounding surface of the mass pad 130. In other embodiments, as illustrated in FIG. 12-14, the attachment portion 180 can take the form of a recess into the surface of the mass pad 130 at a given discrete attachment location 170. In some embodiments, one or more of the discrete attachment locations 170 may be devoid of an attachment portion 180, in such embodiments, the weight bar 150 can be directly attached to one or more surfaces of the mass pad 130, such that the weight bar 150 and the mass pad 130 are flush with one another at the discrete attachment location 170.

In some embodiments, the club head 100 can comprise one or more attachment portions 180 in the form of a tack weld. Rather than an attachment portion 180 provided as a recess or protrusion formed as part of the mass pad 130 geometry, the one or more tack welds (or spot welds) can be provided after the weight bar 150 is already secured to the mass pad 130. The tack weld can be provided between any portion of the weight bar 150 and any portion of the mass pad 130 (i.e. the mass pad central portion 140, heel mass 142, or toe mass 144). The club head 100 can comprise any number of tack welds between the weight bar 150 and the mass pad 130. In some embodiments, the club head 100 can comprise one tack weld, two tack welds, three tack welds, four tack welds, five tack welds, or six tack welds between the weight bar 150 and the mass pad 130. The tack welds can be used in combination with one or more other types of attachment portions 180. In many embodiments, the tack welds can provide vibrational benefits to the club head 100.

The tack welds can reduce unwanted vibrations occurring in the weight bar 150 at impact, improving the sound and feel of the club head 100. Further, controlling unwanted vibrations within the weight bar 150 can improve energy transfer between the club head 100 and the golf ball at impact, as less energy is dissipated by vibrations in the weight bar 150.

Due to the discontinuous attachment between the weight bar 150 and the mass pad 130, the contact area between the weight bar 150 and the mass pad 130 is substantially small. The contact area being substantially small makes more weight available to be strategically moved throughout the golf club head to achieve a better CG location 160 (low and forward) and/or increased perimeter weighting. The weight bar 150 can define a contact area percentage expressed as the percentage of the surface area of the weight bar 150 that is in contact with the mass pad 130, relative to the total surface area of the weight bar 150. In many embodiments, the contact area percentage can be between 1% and 10%. In some embodiments, the contact area percentage can be less than 10%, less than 9%, less than 8%, less than 7%, less than 6%, less than 5%, less than 4%, less than 3%, less than 2%, or less than 1%. The lower contact area percentage, the more efficient the weight bar 150 can be providing a low and forward CG position.

As discussed above, the weight bar 150 is spaced away from the strike face 102. For providing a forward CG location, it is desirable for the weight bar 150 as far forward toward the strike face 102 as possible. However, a space between the weight bar 150 and strike face 102 is necessary to ensure the weight bar 150 does not restrict face flexure. Specifically, during impact with a golf ball, the strike face deforms rearward. The weight bar front surface 152 must be separated from the strike face 102 by a sufficient distance so that the strike face 102 does not contact the weight bar 150 at impact. In many embodiments, the weight bar front surface 152 may be freely exposed within the interior cavity 107, such that no portion of the body 101 contacts the weight bar front surface 152.

Referring to FIG. 6, the weight bar 150 can define a strike face offset distance $D_{SF}$, which is the shortest distance between the weight bar front surface 152 and the rear surface of the strike face 102, measured perpendicular to the loft plane. In many embodiments, the strike face offset distance $D_{SF}$ can be between 0.040 inch and 0.200 inch. In some embodiments, the strike face offset distance $D_{SF}$ can be between 0.040 inch and 0.060 inch, between 0.050 inch and 0.070 inch, between 0.060 inch and 0.080 inch, between 0.070 inch and 0.090 inch, between 0.080 inch and 0.100 inch, between inch and 0.110 inch, between 0.100 inch and 0.120 inch, between 0.110 inch and 0.130 inch, between 0.120 inch and 0.140 inch, between 0.130 inch and 0.150 inch, between 0.140 inch and 0.160 inch, between 0.150 inch and 0.170 inch, between 0.160 inch and 0.180 inch, between 0.170 inch and inch, or between 0.180 inch and 0.200 inch. If the weight bar 150 extends too close to the strike face 102, then the strike face 102 may contact the weight bar 150 during impact, thereby restricting face flexure and reducing ball speed. However, if the weight bar 150 is spaced too far from the strike face 102, the CG will not be provided in a desirable forward position.

Further, as discussed above, the weight bar 150 is spaced away from the sole 112. For providing a low CG location, it is desirable for the weight bar 150 to be as low toward the sole 112 as possible. However, a space between the weight bar 150 and sole 112 is necessary to ensure the weight bar 150 does not restrict sole flexure. As discussed above, the weight bar bottom surface 159 can be spaced away from the sole 112. In many embodiments, the weight bar bottom surface 159 can be freely exposed to the interior cavity 107, such that no portion of the body 101 contacts the weight bar bottom surface 159.

Referring again to FIG. 6, the weight bar 150 can define a sole offset distance $D_S$, which is the shortest distance between the weight bar bottom surface 159 and the interior surface of the sole 112, measured perpendicular to the ground plane 1010. In many embodiments, the sole offset distance $D_S$ can be between 0.040 inch and 0.200 inch. In some embodiments, the sole offset distance $D_S$ can be between 0.040 inch and 0.060 inch, between 0.050 inch and 0.070 inch, between 0.060 inch and inch, between 0.070 inch and 0.090 inch, between 0.080 inch and 0.100 inch, between 0.090 inch and 0.110 inch, between 0.100 inch and 0.120 inch, between 0.110 inch and 0.130 inch, between inch and 0.140 inch, between 0.130 inch and 0.150 inch, between 0.140 inch and 0.160 inch, between 0.150 inch and 0.170 inch, between 0.160 inch and 0.180 inch, between 0.170 inch and 0.190 inch, or between 0.180 inch and 0.200 inch. If the weight bar 150 is placed too close to the sole 112, the weight bar 150 may interfere with the flexure of the sole 112 during impact, thereby reducing ball speed. However, if the weight bar 150 is spaced too far from the sole 112, the CG will not be provided in a desirable low position. Different embodiments of the weight bar 150, described in further detail below, may comprise different offset distances $D_{SF}$, $D_S$ depending on the shape and/or location of the particular weight bar 150.

D. Mass Properties

The suspended weight bar 150 provides a low and forward CG position. The club head 100 comprising a suspended weight bar 150 can comprise a CGy location between −0.10 and −0.25 inch measured relative to the primary coordinate system (described above). It should be noted that a negative CGy value represents the CG distance below the strike face geometric center 120. In some embodiments, the CGy location can be between −0.10 and −0.15 inch, between −0.15 and −0.20 inch, or between −0.20 and −0.25 inch. In some embodiments, the CGy position can be less than −0.10 inch, less than −0.12 inch, less than −0.14 inch, less than −0.16 inch, less than −0.18 inch, less than −0.20 inch, less than −0.22 inch, less than −0.24 inch, or less than −0.25 inch.

The CGy position of the club head 100 comprising a suspended weight bar 150 is lower than a similar club head devoid of a weight bar. In some embodiments, the CGy position of the club head comprising a suspended weight bar 150 can be lower than the CGy position of a similar club head devoid of a weight bar by more than 0.01 inch, more than 0.02 inch, more than 0.03 inch, more than 0.04 inch, more than 0.05 inch, more than 0.06 inch, more than 0.07 inch, more than 0.08 inch, more than 0.09 inch or more than 0.10 inch. Further, the CGy position of the club head comprising a suspended weight bar 150 can be lower than the CGy position of a similar club head devoid of a weight bar by more than 5%, more than 10%, more than 15%, more than 20%, more than 25%, or more than 30%.

The club head 100 comprising a suspended weight bar 150 can comprise a CGz location between −0.15 and −0.05 inch measured relative to the primary coordinate system (described above). It should be noted that a negative CGz value represents the CG distance rearward of the strike face geometric center 120. In some embodiments, the CGz location can be between −0.15 and −0.13 inch, between −0.13 and −0.11 inch, between −0.11 and −0.09 inch, between −0.09 and −0.07 inch, or between −0.07 and −0.05 inch. In some embodiments, the CGz position can be greater than −0.15 inch, less than −0.13 inch, less than −0.11 inch, less than −0.09 inch, less than −0.07 inch, or less than −0.05 inch.

The CGz position of the club head 100 comprising a suspended weight bar 150 is further forward than a similar club head devoid of a weight bar. In some embodiments, the CGz position of the club head comprising a suspended weight bar 150 can be further forward than the CGy position of a similar club head devoid of a weight bar by more than 0.01 inch, more than 0.02 inch, more than 0.03 inch, more than 0.04 inch, more than 0.05 inch, more than 0.06 inch, more than 0.07 inch, more than 0.08 inch, more than 0.09 inch or more than 0.10 inch. Further, the CGz position of the club head comprising a suspended weight bar 150 can be further forward than the CGz position of a similar club head devoid of a weight bar by more than 5%, more than 10%, more than 15%, more than 20%, more than 25%, or more than 30%.

Further, the club head 100 comprising a suspended weight bar 150 can comprise a high moment of inertia. The high moment of inertia increases the forgiveness of the club head on mis-hit shots. In many embodiments, the club head 100 can comprise an Ixx moment of inertia about the X'-axis 1070 between 500 and 800 g*cm$^2$. In some embodiments, the club head 100 can comprise an Ixx between 500 and 550 g*cm$^2$, between 550 and 600 g*cm$^2$, between 600 and 650 g*cm$^2$, between 650 and 700 g*cm$^2$, between 700 and 750 g*cm$^2$, or between 750 and 800 g*cm$^2$. In some embodiments, the club head 100 can comprise an Ixx greater than 500 g*cm$^2$, greater than 550 g*cm$^2$, greater than 600 g*cm$^2$, greater than 650 g*cm$^2$, greater than 700 g*cm$^2$, greater than 750 g*cm$^2$, or greater than 800 g*cm$^2$.

In many embodiments, the club head 100 can comprise an Iyy moment of inertia about the Y'-axis 1080 between 2500 and 3000 g*cm$^2$. In some embodiments, the club head 100 can comprise an Iyy between 2500 and 2550 g*cm$^2$, between 2550 and 2600 g*cm$^2$, between 2600 and 2650 g*cm$^2$, between 2650 and 2700 g*cm$^2$, between 2750 and 2800 g*cm$^2$, between 2800 and 2850 g*cm$^2$, between 2850 and 2900 g*cm$^2$, between 2900 and 2950 g*cm$^2$, or between 2950 and 3000 g*cm$^2$. In some embodiments, the club head 100 can comprise an Iyy greater than 2500 g*cm$^2$, greater than 2550 g*cm$^2$, greater than 2600 g*cm$^2$, greater than 2650 g*cm$^2$, greater than 2700 g*cm$^2$, greater than 2750 g*cm$^2$, greater than 2800 g*cm$^2$, greater than 2850 g*cm$^2$, greater than 2900 g*cm$^2$, greater than 2950 g*cm$^2$, or greater than 3000 g*cm$^2$.

In many embodiments, the club head 100 can comprise an Izz moment of inertia about the Z'-axis 1090 between 2800 and 3400 g*cm$^2$. In some embodiments, the club head 100 can comprise an Izz between 2800 and 2850 g*cm$^2$, between 2850 and 2900 g*cm$^2$, between 2900 and 2950 g*cm$^2$, between 2950 and 3000 g*cm$^2$, between 3000 and 3050 g*cm$^2$, between 3050 and 3100 g*cm$^2$, between 3100 and 3150 g*cm$^2$, between 3150 and 3200 g*cm$^2$, between 3200 and 3250 g*cm$^2$, between 3250 and 3300 g*cm$^2$, between 3300 and 3350 g*cm$^2$, or between 3350 and 3400 g*cm$^2$. In some embodiments, the club head 100 can comprise an Izz greater than 2800 g*cm$^2$, greater than 2850, greater than 2900, greater than 2950, greater than 3000, greater than 3050, greater than 3100, greater than 3150, greater than 3200, greater than 3250, greater than 3300, greater than 3350, or greater than 3400.

II. Embodiments

A. L-Shaped Weight Bar with Raised Attachment Portions

Referring to FIGS. 9-11, the club head 200 in a first embodiment has an "L" shaped suspended weight bar 250 that comprises three distinct regions: a weight bar heel end 254, a weight bar toe end 256, and a weight bar central region 258. The club head 200 is similar to club head 100 and like reference numbers are used to describe the club head 200 (for example, the club head 200 comprises a top rail 210, a sole 212, a heel end 204, a toe end 206, etc.).

In many embodiments, the weight bar central region 258 is defined as the straight, suspended weight bar portion extending between the weight bar heel end 254 and the weight bar toe end 256. The weight bar central region 258 may be spaced forward of the mass pad 230, thereby pushing the club head center of gravity 260 lower and more forward. A low and forward center of gravity aids in achieving a desirable higher launch and increased ball speed with irons. The weight bar heel end 254 comprises an elbow-like bend 263 that turns rearward from the toward the mass pad front wall 232 and creates an "L" shape. The bend 263 allows the weight bar heel end 254 to extend from the mass pad 230 toward the strike face 202, thereby spacing the weight bar central region 258 forward of the mass pad 230. The bend 263 can also provide a flat surface that can be utilized to attach the weight bar heel end 254 to the mass pad 230. In this embodiment, the weight bar heel end 254 is generally thicker than the other portions of the weight bar 250. Further, the bend 263 and increased thickness of the weight bar heel end 254 creates more mass in the heel end 204, which promotes a draw biased shot shape. The weight bar toe end 256 is a flat, tab-like protrusion extending toe-ward from the weight bar central region 258. Because the weight bar toe end 256 is attached to the mass pad 230 at an attachment location close to the face (described in further detail below), the weight bar toe end 256 is thinned to allow room for attachment.

The weight bar 250 can comprise a variable thickness. For example, the weight bar central region 258 thickness may vary such that the central region 258 is thinner near the strike face center 220, and thicker as it extends toward the toe end 206 and the heel end 204. The variable thickness of the weight bar central region 258 can account for the non-uniform strike face deflection experienced during impact with a golf ball. For instance, the strike face 202 experiences more flexure near the center of the face at impact. Thus, making a portion of the weight bar central region 258 near the center of the strike face 202 thinner provides additional space between the weight bar front surface 252 and the strike face rear surface 215. This additional space allows the strike face 202 to flex and not contact the weight bar 250, preventing undesirable feel, sound, and performance. Thinning portions of the weight bar central region 258 can also aid in increasing perimeter weighting, thereby increasing MOI. Further, in some embodiments, the weight bar toe end 256 is generally thinner than the other weight bar 250 portions and the weight bar heel end 254 is generally thicker than the other weight bar 250 portions. In FIG. 11, the weight bar 250 is shown having a trapezoidal cross-section. The weight bar 250 cross-section may be chosen from a variety of alternative shapes including ovals, rectangles, squares, circles, semi-circles, and triangles. The weight bar 250 cross-sectional shape may be strategically chosen to balance the center of gravity 260 location (low and forward)

with manufacturing tolerances and face flexure. The weight bar cross-sectional shape can also vary throughout the weight bar 250.

In other embodiments, the weight bar 250 can comprise a multi-material structure with a higher-density second material making up the weight bar heel end 254 and/or the weight bar toe end 256 (as described above). The weight bar central region 258 can be made of a first material that is less dense than the second material. In such embodiments, this multi-material structure can bias the weight dispersion towards the heel end 204 and the toe end 206 to increase perimeter weighting. Increased perimeter weighting can improve MOI and result in a more forgiving golf club head.

The weight bar 250 is a suspended structure that is fixed at two discrete locations, one heel-ward and the other toe-ward. Aside from the two attachment locations (described in further detail below), the weight bar does not contact the sole 212, strike face rear surface 215, or the mass pad 230. In some embodiments, the weight bar 250 may comprise one or more tack welds to the mass pad 230, which can provide additional support to the weight bar and aid in energy transfer. Energy transfer can be improved through tack welding the weight bar 250 to the mass pad 230 because of vibration damping benefits. The extra attachment between the weight bar 250 to the mass pad 230 provided by the tack welds reduces the weight bar's 250 ability to flex, which inherently limits its ability to vibrate. Therefore, energy is not lost in the vibrations and is instead transferred to the golf ball. The tack weld can be provided between any portion of the weight bar 250 and any portion of the mass pad 230. In many embodiments, the tack weld is provided between the weight bar rear surface 257 and the mass pad front wall 232, at a location along the weight bar central region 258.

The weight bar 250 can be attached to the golf club body at two discrete attachment locations. A first attachment location 270 is located on the front surface of the mass pad central portion 240, more proximate the heel mass 242 than the toe mass 244. Referring to FIG. 10, the mass pad 230 can comprise a first attachment portion 280 at the first attachment location 270. The first attachment portion 280 can comprise a surface that is raised relative to the flat, front surface of the mass pad central portion 240. The first attachment portion 280 being raised serves multiple purposes. The first attachment portion 280 acts as a locating feature to accurately place the weight bar 250 in the correct position. The raised surface of the first attachment portion 280 also allows for easy engagement between the weight bar heel end 254 and mass pad central portion 240, as the flat surfaces of the weight bar heel end 254 and the raised first attachment portion 280 can both be planar. The first attachment portion 280 coupled with the bend 263 in the weight bar heel end 254 provides a more heel-ward center of gravity 260 location, which promotes a draw biased shot shape.

A second attachment location 271 can be located on a flat, forward surface of the toe mass 244, which can create the second attachment portion 281. The toe mass 244 accepts the tab-like weight bar toe end 256. The toe mass 244 is nearer the face than the mass pad central portion 240, therefore, the second attachment location 271 is inherently nearer the strike face rear surface 215 than the first attachment location 270. The weight bar toe end 256 must be thinned relative to the other portions of the weight bar 250 due to its proximity to the strike face rear surface 215, to avoid contacting the strike face rear surface 215 as the strike face 202 flexes at impact.

The tab-like structure of the weight bar toe end 256 allows for the same weight bar 250 to be utilized in different club head bodies having varying blade lengths. Therefore, the weight bar 250 can be utilized in a "one size fits all" manner. This is important for manufacturing because different clubs, within a set of irons, can assume slightly different shapes and lengths to accommodate different lofts. This can alter the shape of the mass pad 230 and the blade length $L_B$. For instance, a greater blade length $L_B$ means that the first attachment location 270 is further from the toe mass 244, therefore less surface area of the weight bar toe end 256 will be in contact with the toe mass 244. Conversely, when the blade length $L_B$ is shorter, the first attachment location 270 is nearer the toe mass 244, so more surface area of the weight bar toe end 256 will be in contact with the toe mass 244.

In addition, since the weight bar 250 can be a one size fits all piece, and the different lofts within a set of irons can change the desired location of the weight bar 250, the first attachment portion 280 can be altered to allow for the proper placement of the weight bar 250. This may result in certain embodiments having a more raised first attachment portion 280 than other embodiments. The amount the first attachment portion 280 extends from the surface of the mass pad 230 can be altered to facilitate attachment between differently-shaped mass pads 230 within a club head set and the weight bar 250.

B. L-Shaped Weight Bar with Recessed Attachment Portions

FIGS. 12-14 illustrate a second embodiment of a club head 300 having an "L" shaped suspended weight bar 350. The weight bar 350 can be substantially similar to weight bar 250, and comprises three distinct regions: a weight bar heel end 354, a weight bar toe end 356, and a weight bar central region 358. The club head 300 is similar to club head 100 and like reference numbers are used to describe the club head 300 (for example, the club head 300 comprises a top rail 310, a sole 312, a heel end 304, a toe end 306, etc.).

In many embodiments, the weight bar central region 358 is defined as the straight, suspended weight bar portion extending between the weight bar heel end 354 and the weight bar toe end 356. The weight bar central region 358 may be spaced forward of the mass pad 330, thereby pushing the club head center of gravity 360 lower and more forward, which is beneficial for higher launch and increased ball speed with irons. The weight bar heel end 354 comprises an elbow-like bend 363 that turns toward the mass pad front wall 332 and creates an "L" shape. The bend 363 allows the weight bar heel end 354 to extend from the mass pad 330 toward the strike face 302, thereby spacing the weight bar central region 358 forward of the mass pad 330. The bend 363 can also provide a flat surface that can be utilized to attach the weight bar heel end 354 to the mass pad 330. In this embodiment, the weight bar 350 has a generally constant thickness. The bend 363 in the weight bar heel end 354 does, however, create more mass in the heel end 304, which promotes a draw biased shot shape. The weight bar toe end 356 can be a similar shape and thickness as the weight bar central region 358.

The weight bar 350, shown in FIGS. 12-14, comprises a constant thickness, however, in other embodiments it can comprise a variable thickness. For example, the weight bar central region 358 thickness may vary such that the weight bar central region 358 is thinner near the center 320 of the strike face 302, and thicker as it extends toward the toe end 306 and the heel end 304. In such embodiments, the variable thickness of the weight bar central region 358 can account for the non-uniform strike face deflection experienced during impact with a golf ball. For instance, the strike face 302 experiences more flexure on impacts nearer the center of the face, thus, making a portion of the weight bar central region 358 nearer the center of the strike face 302 thinner provides additional space between the weight bar front surface 352 and the strike face rear surface 315. This additional space allows the strike face 302 to flex and not contact the weight bar 350, preventing undesirable feel, sound, and performance. Further, thinning portions of the weight bar central region 358 can also aid in increasing perimeter weighting, thereby increasing MOI. In FIG. 14, the weight bar 350 is shown having a substantially rectangular cross-section. The weight bar 350 cross-section may be chosen from a variety of alternative shapes including ovals, trapezoids, squares, circles, semi-circles, and triangles. The weight bar 350 cross-sectional shape may be strategically chosen to balance the center of gravity 360 location (low and forward) with manufacturing tolerances and face flexure. In some embodiments, the weight bar cross-sectional shape can also vary throughout the weight bar 350.

In other embodiments, the weight bar 350 can comprise a multi-material structure with a higher-density second material making up the weight bar heel end 354 and/or the weight bar toe end 356 (as described above). The weight bar central region 358 can be made of a first material that is less dense than the second material. In such embodiments, this multi-material structure can bias the weight dispersion towards the heel end 304 and the toe end 306 to increase perimeter weighting. Increased perimeter weighting can improve MOI and result in a more forgiving golf club head.

The weight bar 350 is a suspended structure that is fixed at two discrete locations, one heel-ward and the other toe-ward, similar to the weight bar 250 of club head 200. Aside from the two attachment locations (described in further detail below), the weight bar does not contact the sole 312, strike face rear surface 315, or the mass pad 330. In some embodiments, the weight bar 350 may comprise one or more tack welds to the mass pad 330, which can provide additional support to the weight bar 350 and aid in energy transfer (described above). The tack weld can be provided between any portion of the weight bar 350 and any portion of the mass pad 330.

The weight bar 350 can be attached to the body 301 at two discrete attachment locations. A first attachment location 370 is located on the front surface of the mass pad central portion 340, more proximate the heel mass 342 than the toe mass 344. Referring to FIG. 12, the mass pad 330 can comprise a first attachment portion 380 at the first attachment location 370. The first attachment portion 380 can comprise a surface that is recessed within the flat, front wall 332 of the mass pad central portion 340. The first attachment portion 380 being recessed into the front wall 332 serves multiple purposes. The first attachment portion 380 acts as a locating feature to accurately place the weight bar 350 in the correct position. The recessed surface of the first attachment portion 380 also allows for easy engagement between the weight bar heel end 354 and mass pad central portion 340, as the weight bar heel end 354 can easily fit within the recessed first attachment portion 380.

A second attachment location 371 can be located on forward surface of the toe mass 344. The toe mass 344 accepts the weight bar toe end 356 with a recess that matches the shape of the weight bar toe end 356. The recessed second attachment portion 381 provides a clear guide for the weight bar 350 placement during installation and may provide more surface area for securely welding or brazing the weight bar 350 to the mass pad 330. The toe mass 344 is nearer the face than the mass pad central portion 340, therefore, the weight bar toe end 356 does not require any bending like the weight bar heel end 354. Contrary to the first embodiment, the second attachment portion 381 being recessed means that the weight bar toe end 356 does not need to be thinned to avoid contacting the strike face rear surface 315 as the strike face 302 flexes at impact.

The constant-shaped, bar-like structure of the weight bar toe end 356 allows for the same weight bar 350 to be utilized in different club head bodies having varying blade lengths. Therefore, the weight bar 350 can be utilized in a "one size fits all" manner. This is important for manufacturing because different clubs, within a set of irons, can assume slightly different shapes and lengths to accommodate different lofts. This can alter the shape of the mass pad 330 and the blade length $L_B$ (as described above). In embodiments with shorter blade lengths $L_B$, the second attachment location 371 will be closer to the first attachment location 370. Therefore, the recessed second attachment portion 381 in the toe mass 344 will need to be longer to receive a larger amount of the weight bar toe end 356. In other embodiments with longer blade lengths $L_B$, the second attachment location 371 will be further away from the first attachment location 370. Therefore, the recessed second attachment portion 381 in the toe mass 344 can be shorter to receive a lesser amount of the weight bar toe end 356.

In addition, since the weight bar 350 can be a one size fits all piece, and the different lofts within a set of irons can change the desired location of the weight bar 350, the first attachment portion 380 can be altered to allow for the proper placement of the weight bar 350. This may result in certain embodiments having a more recessed first attachment portion 380 than other embodiments. The depth in which the first attachment portion 380 sits in from the surface of the mass pad 330 can be altered to facilitate attachment between the weight bar 350 and differently-shaped mass pads 330 within a club head set.

C. Weight Bar Bridging Heel Mass and Toe Mass

Figure 15:
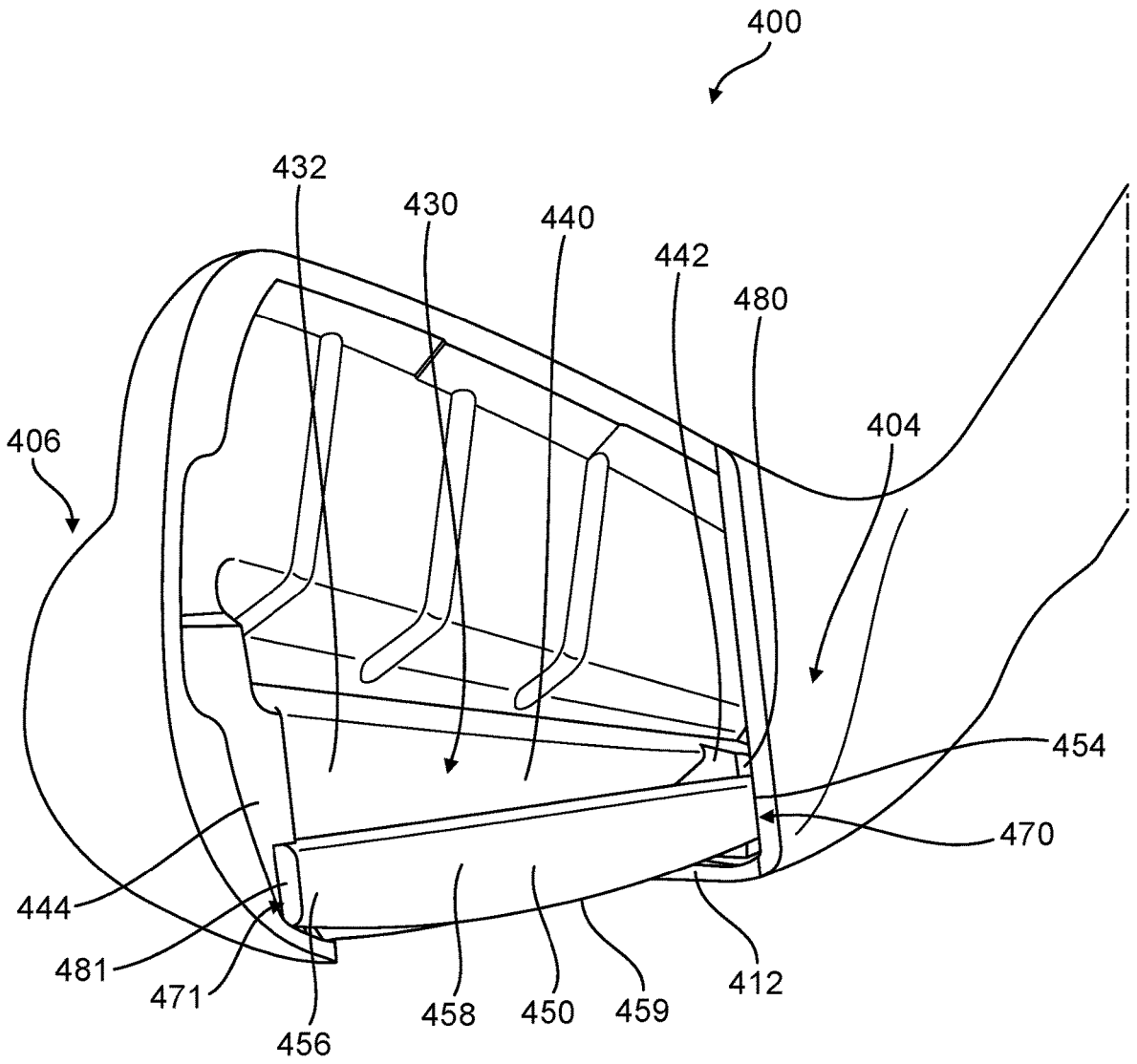
FIG. 15 illustrates a perspective view of a golf club head comprising a suspended weight bar that bridges between a heel mass and a toe mass, wherein the faceplate is removed.

FIG. 15 illustrates a club head 400 in a third embodiment having a straight suspended weight bar 450. The weight bar 450 can be substantially similar to weight bar 250, and comprises three distinct regions: a weight bar heel end 454, a weight bar toe end 456, and a weight bar central region 458. The club head 400 is similar to club head 100 and like reference numbers are used to describe the club head 400 (for example, the club head 400 comprises a top rail 410, a sole 412, a heel end 404, a toe end 406, etc.).

In many embodiments, the weight bar central region 458 is defined as a straight, suspended weight bar portion extending between the weight bar heel end 454 and the weight bar toe end 456. The weight bar central region 458 may be spaced forward of the mass pad 430, thereby pushing the club head center of gravity 460 lower and more forward, which is beneficial for higher launch and increased ball speed with irons. The weight bar heel end 454 comprises a straight portion with a flat rear section used for attachment purposes. The weight bar toe end 456 is similar to the weight bar heel end 454 in that it comprises a straight portion with a flat rear section for attachment purposes. In this embodiment, the weight bar 450 may comprise a radiused weight bar bottom surface 459 (curved in a heel-to-toe direction) to match the curvature of the sole 412 and further lower the center of gravity 460.

The weight bar 450, shown in FIG. 15, comprises a constant thickness, however, in other embodiments it can comprise a variable thickness. For example, the weight bar central region 458 thickness may vary such that the central region 458 is thinner near the center 420 of the strike face 402, and thicker as it extends toward the toe end 406 and the heel end 404. The variable thickness of the weight bar central region 458 can account for the non-uniform strike face deflection experienced during impact with a golf ball. For instance, the strike face 402 experiences more flexure on impacts nearer the center of the face, thus, making a portion of the weight bar central region 458 nearer the center of the strike face 402 thinner provides additional space between the weight bar front surface 452 and the strike face rear surface 415. This additional space allows the strike face 402 to flex and not contact the weight bar 450, preventing undesirable feel, sound, and performance. Further, thinning portions of the weight bar central region 458 can also aid in increasing perimeter weighting, thereby increasing MOI. In FIG. 15, the weight bar 450 is shown having a substantially semi-circle-shaped cross-section. The weight bar 450 cross-section may be chosen from a variety of alternative shapes including ovals, trapezoids, squares, circles, rectangles, and triangles. The weight bar 450 cross-sectional shape may be strategically chosen to balance the center of gravity 460 location (low and forward) with manufacturing tolerances and face flexure. The weight bar cross-sectional shape can also vary throughout the weight bar 450.

In other embodiments, the weight bar 450 can comprise a multi-material structure with a higher-density second material making up the weight bar heel end 454 and/or the weight bar toe end 456 (as described above). The weight bar central region 458 can be made of a first material that is less dense than the second material. In such embodiments, this multi-material structure can bias the weight dispersion towards the heel end 404 and the toe end 406 to increase perimeter weighting. Increased perimeter weighting can improve MOI and result in a more forgiving golf club head.

The weight bar 450 is a suspended structure that is fixed at two discrete locations, one heel-ward and the other toe-ward, forming a bridge between the heel mass 442 and the toe mass 444. Aside from the two attachment locations (described in further detail below), the weight bar does not contact the sole 412, strike face rear surface 415, or the mass pad 430. In some embodiments, the weight bar 450 may comprise one or more tack welds to the mass pad 430, which can provide additional support to the weight bar and aid in energy transfer (described above). The tack weld can be provided between any portion of the weight bar 450 and any portion of the mass pad 430.

The weight bar 450 can be attached to the golf club body at two discrete attachment locations. A first attachment location 470 can be located on the front surface of the heel mass 442. Referring to FIG. 15, the mass pad 430 can comprise a first attachment portion 480 at the first attachment location 470. The first attachment portion 480 can comprise a flat surface on the heel mass 442. The flat first attachment portion 480 provides a surface to allow the flat weight bar heel end 454 to be easily adhered to the heel mass 442. The heel mass 442 is nearer the face than the mass pad central portion 440, therefore, the first attachment location 470 is inherently nearer the strike face rear surface 415. In some embodiments, the weight bar heel end 454 may be thinned relative to the weight bar central region 458 due to its proximity to the strike face rear surface 415, to avoid contacting the strike face rear surface 415 as the strike face 402 flexes at impact.

A second attachment location 471 can be located on the front surface of the toe mass 444. Referring to FIG. 15, the mass pad 430 can comprise a second attachment portion 481 at the second attachment location 471. The second attachment portion 481 can comprise a flat surface on the toe mass 444. The flat second attachment portion 481 provides a surface to allow the flat weight bar toe end 456 to be easily adhered to the toe mass 444. The toe mass 444 is nearer the face than the mass pad central portion 440, therefore, the second attachment location 471 is inherently nearer the strike face rear surface 415. In some embodiments, the weight bar toe end 456 may be thinned relative to the weight bar central region 458 due to its proximity to the strike face rear surface 415, to avoid contacting the strike face rear surface 415 as the strike face 402 flexes at impact. Providing the first attachment location 470 and the second attachment location 471 on the front surfaces of the heel mass 442 and the toe mass 444 allow the weight bar 450 to provide an aggressive forward center of gravity 460 position.

The generally constant-shaped, bar-like structure of the weight bar toe end 456 and weight bar heel end 454 allows for the same weight bar 450 to be utilized in different club head bodies having varying blade lengths. Therefore, the weight bar 450 can be utilized in a "one size fits all" manner. This is important for manufacturing because different clubs, within a set of irons, can assume slightly different shapes and lengths to accommodate different lofts. This can alter the shape of the mass pad 430 and the blade length $L_B$ (as described above). When the blade length $L_B$ is longer, the heel mass 442 and the toe mass 444 may be spaced further apart from one another, whereas when the blade length $L_B$ is shorter, the heel mass 442 and the toe mass 444 may be closer together. The flat nature of the weight bar ends 454, 456 allows the weight bar 450 to easily attach the flat front surfaces of the heel mass 442 and toe mass 444, no matter how close together or far apart the heel mass 442 and toe mass 444 are.

D. Weight Member Attaching to Top Surface of Mass Pad

Figure 16:
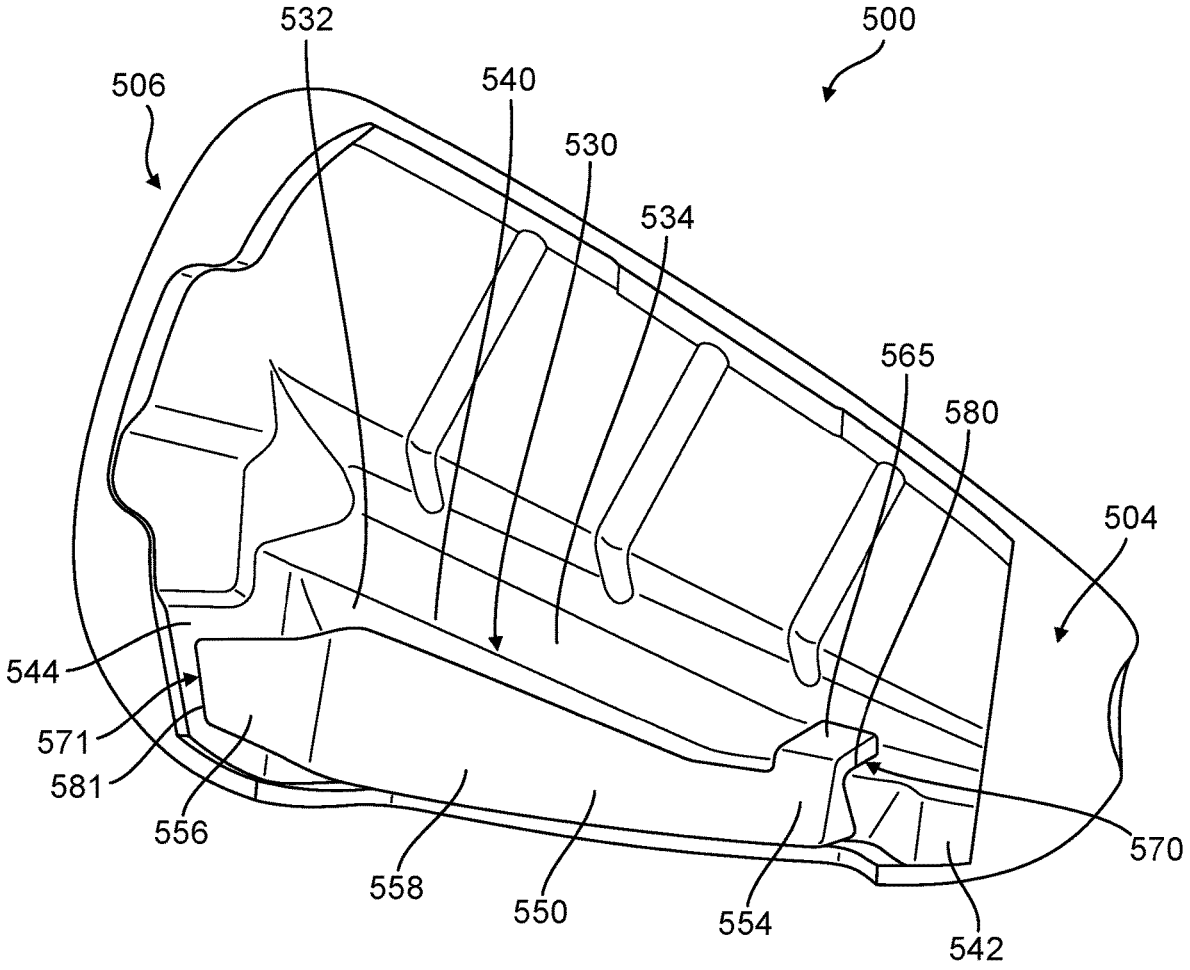
FIG. 16 illustrates a perspective view of a golf club head comprising a weight bar attached to a top wall of a mass pad, wherein the faceplate is removed.
Figure 17:
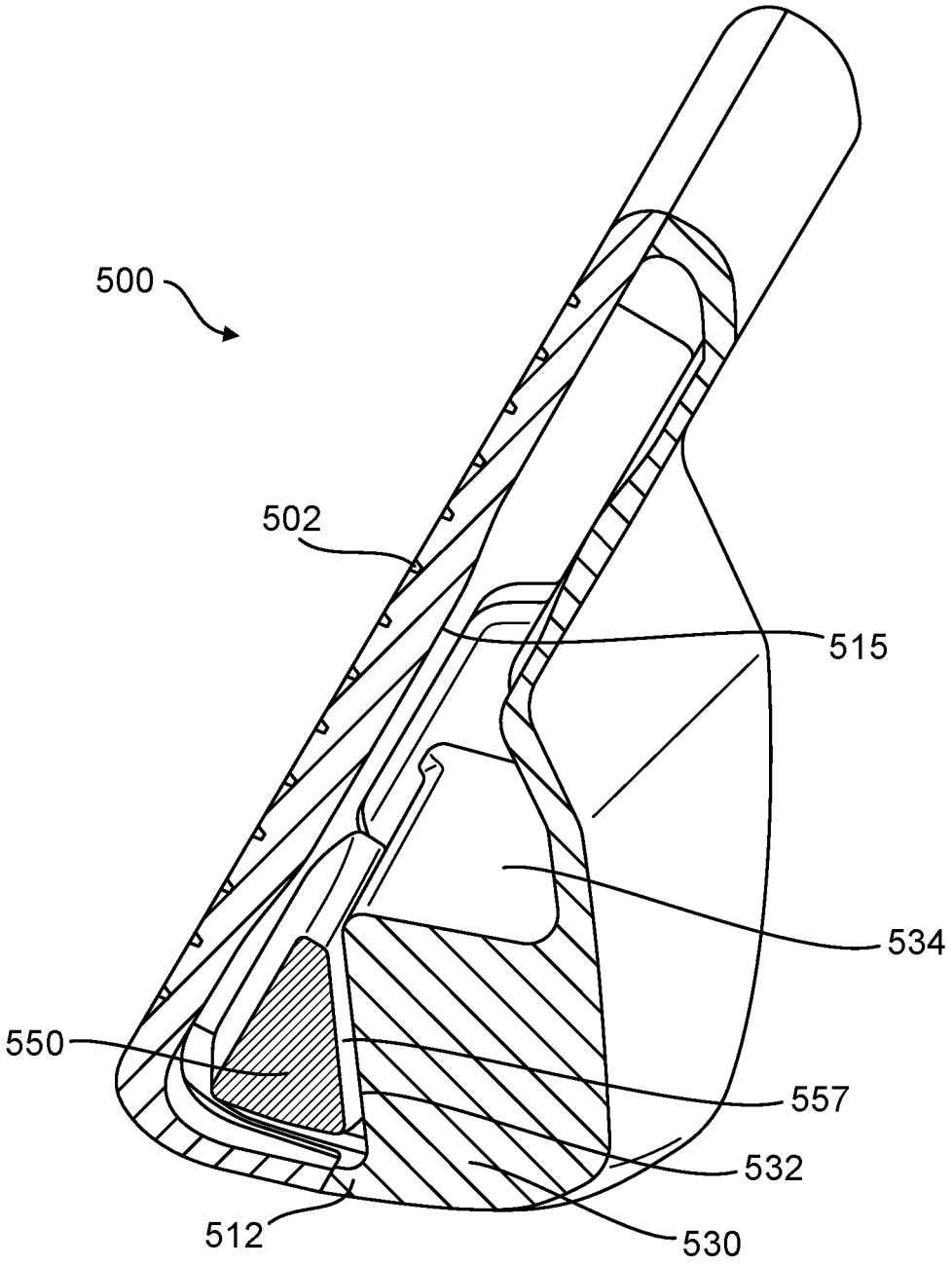
FIG. 17 illustrates a cross-sectional view of the golf club head of FIG. 16.

FIGS. 16 and 17, illustrate a club head 500 in a fourth embodiment having a suspended weight bar 550 that comprises three distinct regions: a weight bar heel end 554, a weight bar toe end 556, and a weight bar central region 558. The club head 500 is similar to club head 100 and like reference numbers are used to describe the club head 500 (for example, the club head 500 comprises a top rail 510, a sole 512, a heel end 504, a toe end 506, etc.).

In many embodiments, the weight bar central region 558 is defined as the straight, suspended weight bar portion extending between the weight bar heel end 554 and the weight bar toe end 556. The weight bar central region 558 may be spaced forward of the mass pad 530, thereby pushing the club head center of gravity 560 lower and more forward. A low and forward center of gravity 560 aids in achieving a desirable higher launch and increased ball speed with irons. As illustrated in FIG. 16, the weight bar heel end 554 comprises a tab-like protrusion 565. The protrusion 565 extends from the top surface and projects rearward toward the mass pad 530. This protrusion 565 can provide a flat surface that can be utilized to attach the weight bar heel end 554 to the mass pad 530. Similar to weight bar toe end 256 of weight bar 250, the weight bar toe end 556 is a flat, tab-like protrusion extending toe-ward from the weight bar central region 558. Because the weight bar toe end 556 is attached to the mass pad 530 at an attachment location close to the face (described in further detail below), the weight bar toe end 556 is thinned to allow room for attachment.

The weight bar 550 can comprise a variable thickness. For example, the weight bar central region 558 thickness may vary such that the central region 558 is thinner near the strike face center 520, and thicker as it extends toward the toe end 506 and the heel end 504. The variable thickness of the weight bar central region 558 can account for the non-uniform strike face deflection experienced during impact with a golf ball. For instance, the strike face 502 experiences more flexure near the center 520 of the strike face 502 at impact. Thus, making a portion of the weight bar central region 558 near the center 520 of the strike face 502 thinner provides additional space between the weight bar front surface 552 and the strike face rear surface 515. This additional space allows the strike face 502 to flex and not contact the weight bar 550, preventing undesirable feel, sound, and performance. Thinning portions of the weight bar central region 558 can also aid in increasing perimeter weighting, thereby increasing MOI. Further, in some embodiments, the weight bar toe end 556 is generally thinner than the other weight bar 550 portions and the weight bar heel end 554 is generally thicker than the other weight bar 550 portions. In FIG. 17, the weight bar 550 is shown having a triangular cross-section. The weight bar 550 cross-section may be chosen from a variety of alternative shapes including ovals, rectangles, squares, circles, semi-circles, and trapezoids. The weight bar 550 cross-sectional shape may be strategically chosen to balance the center of gravity 560 location (low and forward) with manufacturing tolerances and face flexure. The weight bar 550 cross-sectional shape can also vary throughout the weight bar 550.

In other embodiments, the weight bar 550 can comprise a multi-material structure with a higher-density second material making up the weight bar heel end 554 and/or the weight bar toe end 556 (as described above). The weight bar central region 558 can be made of a first material that is less dense than the second material. In such embodiments, this multi-material structure can bias the weight dispersion towards the heel end 504 and the toe end 506 to increase perimeter weighting. Increased perimeter weighting can improve MOI and result in a more forgiving golf club head.

The weight bar 550 is a suspended structure that is fixed at two discrete locations, one heel-ward and the other toe-ward. Aside from the two attachment locations (described in further detail below), the weight bar does not contact the sole 512, strike face rear surface 515, or the mass pad 530. In some embodiments, the weight bar 550 may comprise one or more tack welds to the mass pad 530, which can provide additional support to the weight bar 550 and aid in energy transfer (described above). The tack weld can be provided between any portion of the weight bar 550 and any portion of the mass pad 530. In many embodiments, the tack weld is provided between the weight bar rear surface 557 and the mass pad front wall 532, at a location along the weight bar central region 558.

The weight bar 550 can be attached to the golf club body at two discrete attachment locations. A first attachment location 570 is located on the top wall 534, more proximate the heel mass 542 than the toe mass 544. Referring to FIG. 16, the mass pad 530 can comprise a first attachment portion 580 at the first attachment location 570. In some embodiments, the first attachment portion 580 can comprise a flat surface on the top wall 534. The top wall 534 creates a shelf that the tab-like protrusion 565 on the weight bar heel end 554 can be adhered flush upon.

A second attachment location 571 can be located on a flat, forward surface of the toe mass 544. The toe mass 544 accepts the tab-like weight bar toe end 556. The toe mass 544 is nearer the face than the mass pad central portion 540, therefore, the second attachment location 571 is inherently nearer the strike face rear surface 515 than the first attachment location 570. The weight bar toe end 556 must be thinned relative to the other portions of the weight bar 550 due to its proximity to the strike face rear surface 515, to avoid contacting the strike face rear surface 515 as the strike face 502 flexes at impact.

The tab-like structure of the weight bar toe end 556 allows for the same weight bar 550 to be utilized in different club head bodies having varying blade lengths. Therefore, the weight bar 550 can be utilized in a "one size fits all" manner. This is important for manufacturing because different clubs, within a set of irons, can assume slightly different shapes and lengths to accommodate different lofts. This can alter the shape of the mass pad 530 and the blade length $L_B$ (as described above).

In addition, since the weight bar 550 can be a one size fits all piece, and the different lofts within a set of irons can change the desired attachment locations 570, 571 of the weight bar 550, the first attachment portion 580 can be altered to allow for the proper placement of the weight bar 550. This may result in certain embodiments having a raised or recessed first attachment portion 580. The amount the first attachment portion 580 recesses or extends from the top wall 534 can be altered to facilitate attachment between differently-shaped mass pads 530 within a club head set and the weight bar 550.

III. Additional Features

The various embodiments of the club heads comprising a suspended weight bar described herein can comprise one or more additional features that provide increased performance. The various features described below can be provided in any combination and can be applied to the club heads described in any of the various embodiments described above.

A. L-Shaped Faceplate

Figure 18:
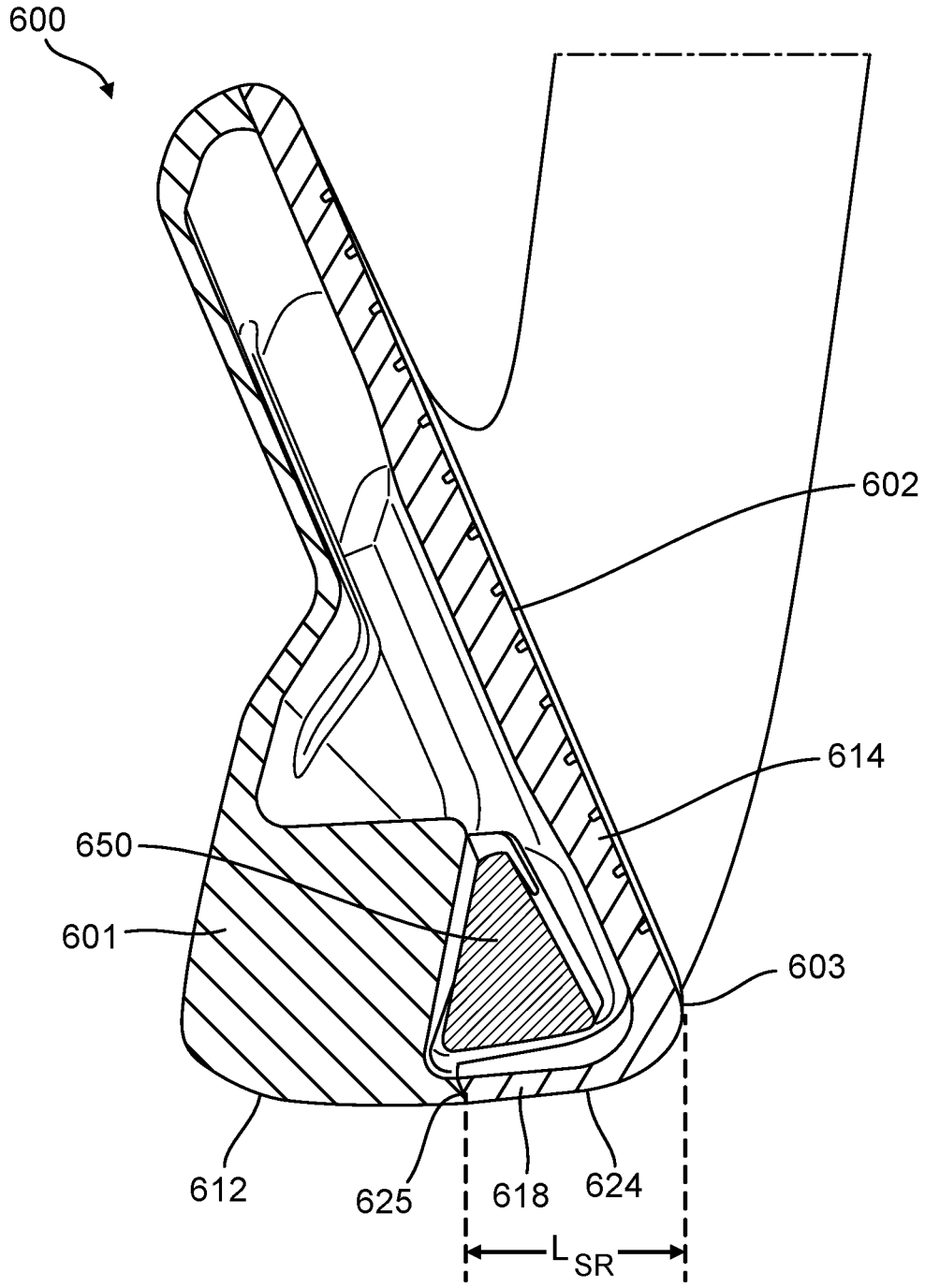
FIG. 18 illustrates a cross-sectional view of a golf club head comprising a suspended weight bar and an L-shaped faceplate.

FIG. 18 illustrates an embodiment of a club head 600 comprising a weight bar 650 and an L-shaped faceplate 614 having a sole return 624. The sole return 624 can provide the club head 600 with increased ball speed. The L-shaped faceplate 614 forms the strike face 602 and wraps over the leading edge 603. The sole return 624 extends rearward from the leading edge 603 and forms at least part of the thin sole portion 618.

The L-shaped faceplate 614 and the body 601 can comprise different materials. As described above, the body 601 can be formed of a steel alloy or other suitable material that can easily be cast into the complex geometries necessary for forming the body 601. The faceplate material can be a higher strength material than the body material. In many embodiments, the faceplate material can be a maraging steel such as C300. In other embodiments, the faceplate material can be a high-strength steel or steel alloy, C250, C350, AerMet® 100, AerMet® 310, AerMet® 340, HSR300, K300 or any other high-strength material suitable of being formed into an L-shaped faceplate 614. Providing an L-shaped faceplate 614 with a sole return 624 allows part of the thin sole portion 618 to be formed of the higher-strength faceplate material, rather than by the body material.

Due to the high-strength faceplate material, the inclusion of the sole return 624 allows the thin sole portion 618 to be thinned without sacrificing durability. The thinning of the thin sole portion 618 promotes an increased ball speed by increasing the flexibility of the sole 612. The sole return 624 can comprise a sole return thickness measured from an interior surface of the sole return 624 to an exterior surface of the sole 612. In many embodiments, the sole return thickness can range from approximately 0.035 inch to approximately 0.060 inch. In some embodiments, the sole return thickness can be between 0.035 inch and 0.045 inch, between 0.040 inch and 0.050 inch, between inch and 0.055 inch, or between 0.050 inch and 0.060 inch. In some embodiments, the sole return thickness can be between 0.035 inch and 0.040 inch, between 0.035 inch and 0.045 inch, between 0.035 inch and 0.050 inch, between 0.035 inch and 0.055 inch, or between 0.035 inch and inch. The sole return thickness is selected to maximize the flexure of the L-shaped faceplate 614 and the sole 612, while providing structural integrity to the leading edge 603.

The combination of the L-shaped faceplate 614 and the suspended weight bar 650 creates a flexible club head 600 with a desirable low and forward CG position. As illustrated in FIG. 18, the weight bar 650 overhangs the sole return 624 without contacting any portion of the sole return 624. The spacing between the weight bar 650 and the sole return 624 allows the sole return 624 to be lengthened without being hindered by the weight bar 650. Lengthening the sole return 624 leads to increased ball speed by providing more high-strength faceplate material on the sole 612.

As illustrated in FIG. 18, the sole return 624 comprises a sole return length $L_{SR}$ measured as the maximum front-to-back distance, parallel to the Z-axis 1060, between the leading edge 703 and a sole return rear edge 625. In many embodiments, the sole return length $L_{SR}$ can be between 0.2 inch and 0.4 inch. In some embodiments, the sole return length $L_{SR}$ can be between 0.2 inch and 0.25 inch, between 0.25 inch and 0.275 inch, between 0.275 inch and 0.3 inch, between 0.3 inch and 0.325 inch, between 0.325 inch and 0.35 inch, between 0.35 inch and 0.375 inch, or between 0.375 inch and 0.4 inch. In many embodiments, the sole return length $L_{SR}$ can be greater than 0.2 inches. In some embodiments, the sole return length $L_{SR}$ can be greater than 0.2 inch, 0.225 inch, 0.25 inch, 0.275 inch, 0.3 inch, 0.325 inch, 0.35 inch, or 0.375 inch.

B. Back Ribs

Figure 19:
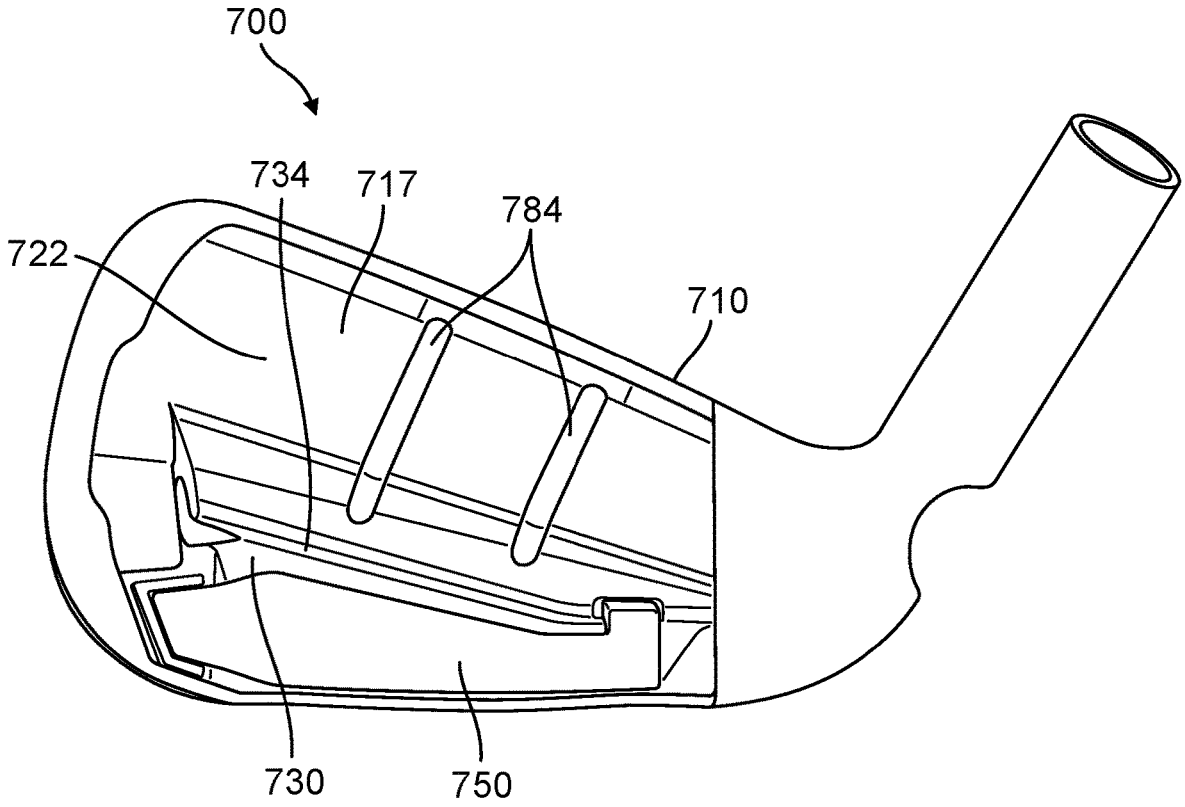
FIG. 19 illustrates a front view of a golf club head comprising a suspended weight bar and a plurality of back wall ribs, wherein the faceplate is removed.
Figure 20:
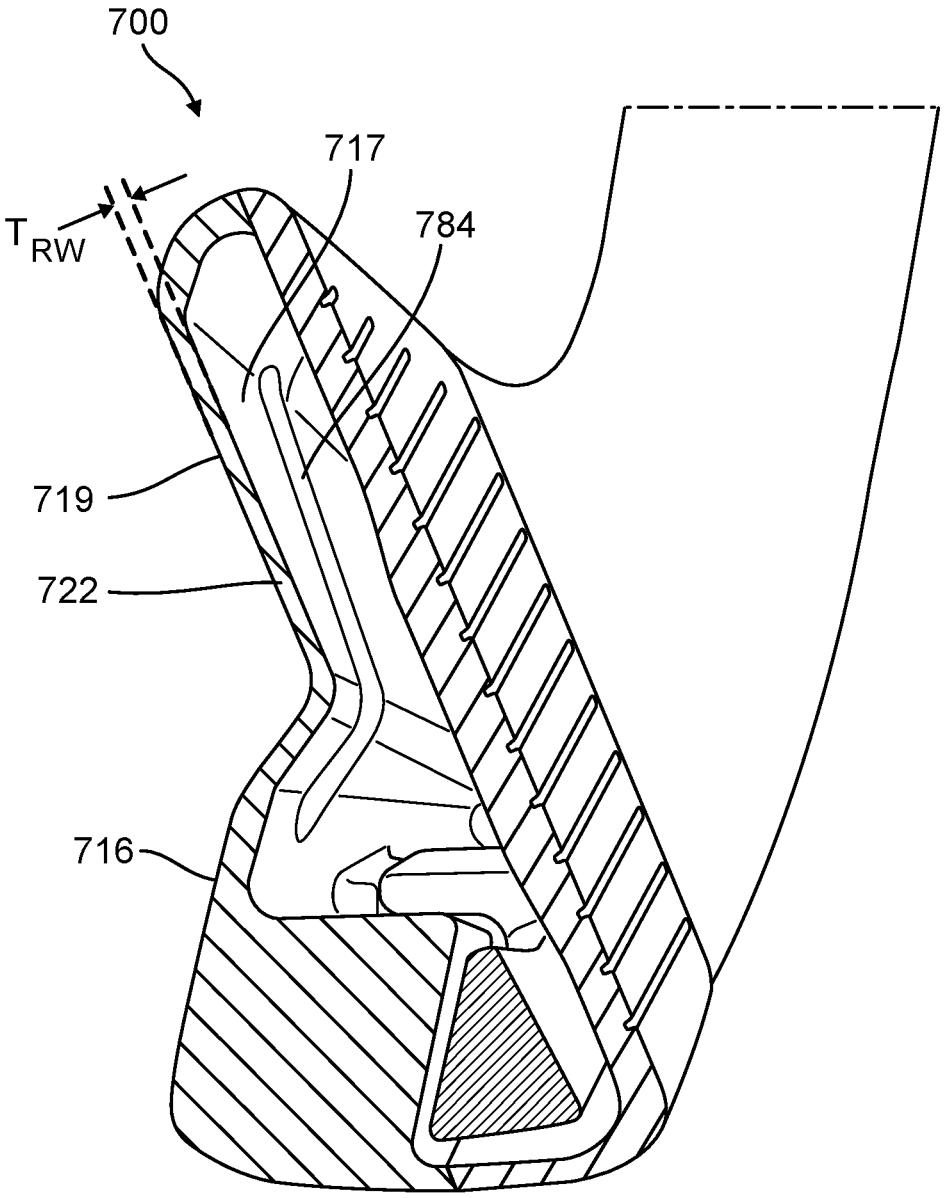
FIG. 20 illustrates a cross-sectional view of the golf club head of FIG. 19.

FIGS. 19-20 illustrate an embodiment of a club head 700 comprising a suspended weight bar 750 and a plurality of rear wall ribs 784. The plurality of rear wall ribs 784 can protrude from a rear wall interior surface 717 and into the interior cavity 707. In the illustrated embodiment, the rear wall ribs 784 can be located on the surface of a rear wall upper portion 722 wherein the rear wall upper portion is located above the mass pad 730 and extends from the mass pad top wall 734 to the top rail 710. In the illustrated embodiment, the plurality of rear wall ribs 784 extend in a direction from top rail 710 toward the mass pad top wall 734. In other embodiments, the plurality of rear wall ribs 784 can be located anywhere on the rear wall interior surface 717 and can extend in any direction, including a diagonal direction, a vertical direction, or a heel-to-toe direction.

The plurality of rear wall ribs 784 provide the club head 700 with an improved sound response upon impact with a golf ball. The rear wall ribs 784 damp dominant vibrations occurring in the rear wall 716, and specifically in the rear wall upper portion 722. Further, the rear wall ribs 784 can locally reinforce the rear wall upper portion 722 allowing the rear wall upper portion 722 to be thinned. Thinning the rear wall upper portion 722 lowers the center of gravity 760 and increases the flexibility of the rear wall upper portion 722. The increased flexibility increases the energy transfer between the club head 700 and the golf ball at impact, resulting in faster ball speed. The rear wall ribs 784 provide vibrational benefits and localized reinforcement without inhibiting the flexure of the rear wall upper portion 722.

In many embodiments, the inclusion of the rear wall ribs 784 allows the rear wall upper portion 722 to be substantially thin. In many embodiments, the rear wall upper portion 722 comprises a rear wall thickness $T_{RW}$ measured from the rear wall interior surface 717 to the rear wall exterior surface 719 less than approximately 0.070 inch. In some embodiments, the rear wall thickness $T_{RW}$ can be less than approximately 0.065 inch, less than approximately 0.060 inch, less than approximately 0.055 inch, less than approximately 0.050 inch, less than approximately 0.045 inch, less than approximately 0.040 inch, less than approximately 0.035 inch, less than approximately 0.030 inch, or less than approximately 0.025 inch. In some embodiments, the rear wall thickness $T_{RW}$ can be between 0.025 inch to 0.050 inch, 0.035 inch to 0.050 inch, 0.040 inch to 0.065 inch, or 0.045 inch to 0.070 inch.

EXAMPLES

Example 1: Mass Properties of Club Head with a Suspended Weight Bar

Table 1 below illustrates the mass properties of an exemplary club head according to the embodiments described. The exemplary club head was substantially similar to club head 500 illustrated in FIGS. 17 and 18. The exemplary club head comprised a mass pad and an L-shaped suspended weight bar within the interior cavity. The suspended weight bar was attached to the mass pad at a plurality of discrete attachment locations including a first attachment location on the top wall of the mass pad central portion and a second attachment location on the front surface of the toe mass.

TABLE 1

| Club Head | Exemplary |
|---|---|
| Ixx (g*cm$^2$) | 651.5 |
| Iyy (g*cm$^2$) | 2655 |
| Izz (g*cm$^2$) | 3042 |
| CGy (in) | −0.12 |
| CGz (in) | −0.13 |

As evidenced by Table 1, the suspended weight bar provided a low and forward CG location for the exemplary club head. The exemplary club head exhibited a CGy location that was 0.12 inch below face center. Further, the exemplary club head exhibited a CGz location that was 0.13 inch rearward of face center. Additionally, the exemplary club head exhibited substantially high MOI values in relation to prior art hollow-body irons. The suspended weight bar therefore provides a club head that achieves a desirable CG position without compromising MOI.

Example 2: Performance Test of Club Head with a Suspended Weight Bar

A performance test was conducted to compare the performance characteristics of a plurality of exemplary club heads according to the embodiments described herein to the performance characteristics of a control club head.

The test involved the exemplary club head described above in Example 1 (hereafter the "first exemplary club head"), a second exemplary club head, and a control club head. The second exemplary club head was substantially similar to the first exemplary club head, except that the second exemplary club head comprised a single tack weld between the weight bar central region and the mass pad front wall. The control club head was similar to the first and second exemplary club heads, but the control club head was devoid of a weight bar.

The performance test measured the ball speeds, launch angles, and spin rates of each club head. An automated performance test used a golf swing apparatus to capture performance data of each club head under regular conditions. The performance test evaluated strike locations at the geometric center of the face as well as at strike locations 0.3 inch below the geometric center of the strike face. The results of the performance test are demonstrated in Table 2 below.

TABLE 2

| Club Head | Exemplary 1 | Exemplary 2 | Control |
|---|---|---|---|
| Center Strike Ball Speed (mph) | 126.2 | 126.3 | 126.0 |
| Low Strike Ball Speed (mph) | 124.1 | 123.8 | 123.2 |
| Center Strike Launch Angle (degrees) | 20.1 | 20.4 | 20.0 |
| Low Strike Launch Angle (degrees) | 19.1 | 18.8 | 18.6 |
| Center Strike Spin Rate (rpm) | 5836.3 | 5731.7 | 5737.4 |
| Low Strike Spin Rate (rpm) | 6033.8 | 6168.8 | 5934.0 |

As evidenced by Table 2, the exemplary club heads exhibited improvements over the control club head. Regarding ball speed, the exemplary club heads exhibited marginal gains over the control club head on center strikes. The first exemplary club head exhibited a 0.2 mph ball speed increase, and the second exemplary club head exhibited a 0.3 mph ball speed increase over the control club head. The exemplary club heads each exhibited more significant gains over the control club head on low strikes. On low strikes, the first exemplary club head exhibited a 0.9 mph ball speed increase, and the second exemplary club head exhibited a 0.6 mph ball speed increase over the control club head.

Regarding launch angle, the exemplary club heads showed improvement over the control club head, particularly on low strikes. The exemplary club heads showed marginal improvements over the control club head on center strikes. The first exemplary club head exhibited a 0.1 degree launch angle increase, and the second exemplary club head exhibited a 0.3 degree launch angle increase over the control club head. Again, the exemplary club heads showed more significant improvements over the control club head on low strikes. On low strikes, the first exemplary club head exhibited a 0.5 degree launch angle increase, and the second exemplary club head exhibited a 0.2 degree launch angle increase over the control club head. The increase in launch angle can correlate to an increase in the peak height and/or the stopping power of the club head. In some instances, the increased launch angle can allow the club head to be delofted to further increase ball speed without compromising stopping power.

Regarding spin rate, the exemplary club heads showed improvement over the control club head, particularly on low strikes. On center strikes, the first exemplary club head exhibited a significant increase in spin by 99 rpm over the control club head. On center strikes, the second exemplary club head exhibited a 5.7 rpm spin rate decrease in comparison to control club head, however, this reduction is negligible (less than 0.001% decrease). On low strikes, both exemplary club heads exhibited significant improvements over the control club head. On low strikes, the first exemplary club head exhibited an increase in spin by 99 rpm, and the second exemplary club head exhibited an increase in spin by 234.8 rpm over the control club head. The increase in spin exhibited by the exemplary club heads over the control club head correlates to an improvement in the stopping power of the exemplary club heads, making it easier to keep a golf shot on the green.

The results of the performance test demonstrate the performance advantages of the suspended weight bar. The suspended weight bar provides a low and forward CG (as discussed in Example 1), which leads to an increase in ball speed, launch angle, and spin rate. The combination of an increased ball speed, launch angle, and spin rate produces a high-performing club head that maximizes distance and stopping power.

As the rules of golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard, unless expressly stated otherwise.

As explained previously, while the above examples may be described in connection with an iron-type golf club, the apparatus, methods, and articles of manufacture described herein may be applicable to other types of golf club, such as a fairway wood-type golf club, a hybrid-type golf club, a wedge-type golf club, or a driver-type golf club. In other embodiments, the apparatus, methods, and articles of manufacture described herein may be applicable to other type of sports equipment, such as a hockey stick, a tennis racket, a fishing pole, a ski pole, etc.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting.

CLAUSES

Clause 1. A golf club head comprising a body comprising a strike face, a mass pad, a sole, a top rail, a rear wall, and a hosel; the body enclosing a hollow interior cavity; wherein the mass pad is located within the hollow interior cavity proximate the sole and the rear wall; the mass pad comprises a toe mass, a heel mass, and a mass pad central portion between the toe mass and the heel mass; a weight bar formed separately from the body and coupled thereto; wherein the weight bar is fully enclosed within the interior cavity; wherein the weight bar discontinuously engages the mass pad, such that the weight bar is attached to the mass pad at a plurality of discrete attachment locations; wherein the mass pad is the only portion of the body in contact with the weight bar; wherein the plurality of discrete attachment locations comprises a first attachment location on a forward surface of the mass pad central portion and a second attachment location on the toe mass.

Clause 2. The golf club head of clause 1, wherein the weight bar and the body comprise the same material.

Clause 3. The golf club head of clause 1, wherein the weight bar comprises a cross-sectional shape selected from the group consisting of: trapezoids, ovals, rectangles, squares, circles, semi-circles, and triangles.

Clause 4. The golf club head of clause 1, wherein the weight bar engages the mass pad via brazing.

Clause 5. The golf club head of clause 1, wherein the weight bar engages the mass pad via welding.

Clause 6. The golf club head of clause 1, wherein the weight bar comprises a weight bar length LW measured in a heel-to-toe direction; wherein the weight bar length LW is greater than 2.0 inches.

Clause 7. The golf club head of clause 6, further comprising a hosel axis extending through and concentric to the hosel; a blade length $L_B$ defined as a heel-to-toe distance between a toe-most point of the golf club head and an intersection point between the hosel axis and the sole; a ratio $L_W/L_B$ defined as the weight bar length $L_W$ divided by blade length $L_B$; and wherein the ratio $L_W/L_B$ is greater than 0.6.

Clause 8. The golf club head of clause 1, wherein the mass pad forms a first attachment portion at the first attachment location; wherein the first attachment portion is raised relative to a front surface of the central mass pad portion.

Clause 9. The golf club head of clause 1, wherein the first attachment location is located closer to the heel mass than to the toe mass.

Clause 10. A golf club head comprising a body comprising a strike face, a mass pad, a sole, a top rail, and a rear wall; the body enclosing a hollow interior cavity; a ground plane tangent to the sole at an address position; a loft plane tangent to the strike face; wherein the mass pad is located within the hollow interior cavity proximate the sole and the rear wall; the mass pad comprises a toe mass, a heel mass, and a mass pad central portion between the toe mass and the heel mass; a weight bar formed separately from the body and coupled thereto; wherein the weight bar is fully enclosed within the interior cavity; wherein the weight bar discontinuously engages the mass pad, such that the weight bar is attached to the mass pad at a plurality of discrete attachment locations; wherein the weight bar comprises a weight bar front surface facing the strike face and a weight bar bottom surface facing the sole; wherein the weight bar front surface is spaced from the strike face and the weight bar bottom surface is spaced from the sole; and wherein the body does not contact any portion of the weight bar front surface or the weight bar bottom surface.

Clause 11. The golf club head of clause 10, further comprising a sole offset distance $D_S$ measured as the shortest distance between the weight bar bottom surface and an interior surface of the sole, measured perpendicular to the ground plane; wherein the sole offset distance $D_S$ is between 0.040 inch and 0.200 inch.

Clause 12. The golf club head of clause 10, further comprising a strike face offset distance $D_{SF}$ measured as the shortest distance between the weight bar front surface and a rear surface of the strike face, measured perpendicular to the loft plane; wherein the strike face offset distance $D_{SF}$ is between 0.040 inch and 0.200 inch.

Clause 13. The golf club head of clause 10, wherein the weight bar engages the mass pad via brazing.

Clause 14. The golf club head of clause 10, wherein the weight bar engages the mass pad via welding.

Clause 15. A golf club head comprising a body comprising a strike face comprising a strike face leading edge, a mass pad, a sole, a top rail, and a rear wall; the body enclosing a hollow interior cavity; wherein the mass pad is located within the hollow interior cavity proximate the sole and the rear wall; the mass pad comprises a toe mass, a heel mass, and a mass pad central portion between the toe mass and the heel mass; a weight bar formed separately from the body and coupled thereto; wherein the weight bar is fully enclosed within the interior cavity; wherein the weight bar discontinuously engages the mass pad, such that the weight bar is attached to the mass pad at a plurality of discrete attachment locations; a thin sole portion between the strike face and the mass pad; wherein the weight bar is located forward of the mass pad and overhangs the thin sole portion an overhang distance $D_O$ measured as a front-to-back distance between a weight bar forward-most point and a base of the mass pad; and wherein the overhang distance $D_O$ is between 0.10 inch and inch.

Clause 16. The golf club head of clause 15, wherein the thin sole portion comprises a minimum thin sole portion thickness measured between an exterior surface of the sole and an interior surface of the thin sole portion; and wherein the minimum thin sole portion thickness is less than inch.

Clause 17. The golf club head of clause 15, wherein a thin sole portion length $L_{TS}$ is measured as a front-to-back distance between the strike face leading edge and the base of the mass pad; and wherein the thin sole portion length $L_{TS}$ is greater than 0.100 inch.

Clause 18. The golf club head of clause 15, wherein the weight bar engages the mass pad via brazing.

Clause 19. The golf club head of clause 15, wherein the weight bar engages the mass pad via welding.

Clause 20. The golf club head of clause 15, wherein the weight bar comprises a different material than the body.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to $ocm^3ur$ or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a body comprising a strike face, a mass pad, a sole, a top rail, a rear wall, and a hosel;

the body enclosing a hollow interior cavity;

wherein the mass pad is located within the hollow interior cavity proximate the sole and the rear wall;

the mass pad comprises a toe mass, a heel mass, and a mass pad central portion between the toe mass and the heel mass;

a weight bar formed separately from the body and coupled thereto;

wherein the weight bar is fully enclosed within the interior cavity;

wherein the weight bar discontinuously engages the mass pad, such that the weight bar is attached to the mass pad at a plurality of discrete attachment locations;

wherein the mass pad is the only portion of the body in contact with the weight bar; and wherein the plurality of discrete attachment locations comprises a first attachment location on a forward surface of the mass pad central portion and a second attachment location on the toe mass.

2. The golf club head of claim 1, wherein the weight bar and the body comprise the same material.

3. The golf club head of claim 1, wherein the weight bar comprises a cross-sectional shape selected from the group consisting of: trapezoids, ovals, rectangles, squares, circles, semi-circles, and triangles.

4. The golf club head of claim 1, wherein the weight bar engages the mass pad via brazing.

5. The golf club head of claim 1, wherein the weight bar engages the mass pad via welding.

6. The golf club head of claim 1, wherein the weight bar comprises a weight bar length $L_W$ measured in a heel-to-toe direction; wherein the weight bar length $L_W$ is greater than 2.0 inches.

7. The golf club head of claim 6, further comprising a hosel axis extending through and concentric to the hosel;

a blade length $L_B$ defined as a heel-to-toe distance between a toe-most point of the golf club head and an intersection point between the hosel axis and the sole;

a ratio $L_W/L_B$ defined as the weight bar length $L_W$ divided by blade length $L_B$; and wherein the ratio $L_W/L_B$ is greater than 0.6.

8. The golf club head of claim 1, wherein the mass pad forms a first attachment portion at the first attachment location; wherein the first attachment portion is raised relative to a front surface of the central mass pad portion.

9. The golf club head of claim 1, wherein the first attachment location is located closer to the heel mass than to the toe mass.

10. A golf club head comprising:

a body comprising a strike face, a mass pad, a sole, a top rail, and a rear wall;

the body enclosing a hollow interior cavity;

a ground plane tangent to the sole at an address position;

a loft plane tangent to the strike face;

wherein the mass pad is located within the hollow interior cavity proximate the sole and the rear wall;

the mass pad comprises a toe mass, a heel mass, and a mass pad central portion between the toe mass and the heel mass;

a weight bar formed separately from the body and coupled thereto;

wherein the weight bar is fully enclosed within the interior cavity;

wherein the weight bar discontinuously engages the mass pad, such that the weight bar is attached to the mass pad at a plurality of discrete attachment locations;

wherein the weight bar comprises a weight bar front surface facing the strike face and a weight bar bottom surface facing the sole;

wherein the weight bar front surface is spaced from the strike face and the weight bar bottom surface is spaced from the sole; and wherein the body does not contact any portion of the weight bar front surface or the weight bar bottom surface.

11. The golf club head of claim 10, further comprising a sole offset distance $D_S$ measured as the shortest distance between the weight bar bottom surface and an interior surface of the sole, measured perpendicular to the ground plane; and wherein the sole offset distance $D_S$ is between 0.040 inch and 0.200 inch.

12. The golf club head of claim 10, further comprising a strike face offset distance $D_{SF}$ measured as the shortest distance between the weight bar front surface and a rear surface of the strike face, measured perpendicular to the loft plane; and wherein the strike face offset distance $D_{SF}$ is between 0.040 inch and 0.200 inch.

13. The golf club head of claim 10, wherein the weight bar engages the mass pad via brazing.

14. The golf club head of claim 10, wherein the weight bar engages the mass pad via welding.

15. A golf club head comprising:

a body comprising:

a strike face comprising a strike face leading edge, a mass pad, a sole, a top rail, and a rear wall;

the body enclosing a hollow interior cavity;

wherein the mass pad is located within the hollow interior cavity proximate the sole and the rear wall;

the mass pad comprises a toe mass, a heel mass, and a mass pad central portion between the toe mass and the heel mass;

a weight bar formed separately from the body and coupled thereto;

wherein the weight bar is fully enclosed within the interior cavity;

wherein the weight bar discontinuously engages the mass pad, such that the weight bar is attached to the mass pad at a plurality of discrete attachment locations;

a thin sole portion between the strike face and the mass pad;

wherein the weight bar is located forward of the mass pad and overhangs the thin sole portion an overhang distance $D_O$ measured as a front-to-back distance between a weight bar forwardmost point and a base of the mass pad; and wherein the overhang distance $D_O$ is between 0.10 inch and 0.50 inch.

16. The golf club head of claim 15, wherein the thin sole portion comprises a minimum thin sole portion thickness measured between an exterior surface of the sole and an interior surface of the thin sole portion; and wherein the minimum thin sole portion thickness is less than 0.070 inch.

17. The golf club head of claim 15, wherein a thin sole portion length $L_{TS}$ is measured as a front-to-back distance between the strike face leading edge and the base of the mass pad; and wherein the thin sole portion length $L_{TS}$ is greater than 0.100 inch.

18. The golf club head of claim 15, wherein the weight bar engages the mass pad via brazing.

19. The golf club head of claim 15, wherein the weight bar engages the mass pad via welding.

20. The golf club head of claim 15, wherein the weight bar comprises a different material than the body.

* * * * *